US006677097B2

(12) United States Patent
Ohmura et al.

(10) Patent No.: US 6,677,097 B2
(45) Date of Patent: Jan. 13, 2004

(54) TONER FOR DEVELOPING STATIC IMAGE AND AN IMAGE FORMING METHOD

(75) Inventors: Ken Ohmura, Hachioji (JP); Asao Matsushima, Hachioji (JP); Shiro Hirano, Hachioji (JP); Yoshiki Nishimori, Hachioji (JP); Hiroyuki Yamada, Hachioji (JP); Hiroshi Yamazaki, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/099,081

(22) Filed: Mar. 15, 2002

(65) Prior Publication Data

US 2003/0049554 A1 Mar. 13, 2003

(30) Foreign Application Priority Data

Mar. 21, 2001 (JP) ..... 2001-079670
Mar. 26, 2001 (JP) ..... 2001-086534

(51) Int. Cl.[7] ..... G03G 9/08
(52) U.S. Cl. ..... 430/110.3; 430/110.1
(58) Field of Search ..... 430/110.3, 110.1

(56) References Cited

U.S. PATENT DOCUMENTS 5,665,508 A * 9/1997 Inagaki et al. ..... 430/108
5,932,386 A * 8/1999 Anno et al. ..... 430/106
6,190,816 B1 * 2/2001 Takehara et al. ..... 430/110

* cited by examiner

*Primary Examiner*—John Goodrow
(74) *Attorney, Agent, or Firm*—Muserlian, Lucas and Mercanti

(57) ABSTRACT

A toner for developing a static image comprising at least a resin, colorant and crystalline substance is disclosed. The toner particle has a domain-matrix structure and the domain has an average of the ratio of the major axis to the minor axis of from 1.5 to 2.5 when the domain is approximated by an ellipse.

21 Claims, 8 Drawing Sheets

TONER PARTICLE (a)

TONER PARTICLE (b)

TONER PARTICLE HAVING NO CORNERS

TONER PARTICLE HAVING CORNERS

TONER PARTICLE HAVING CORNERS

FIG. 9 ( a )
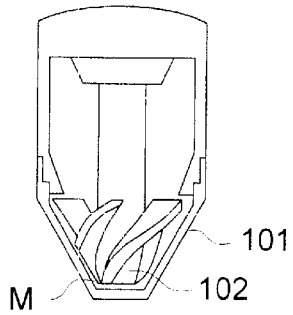
FIG. 9 ( b )
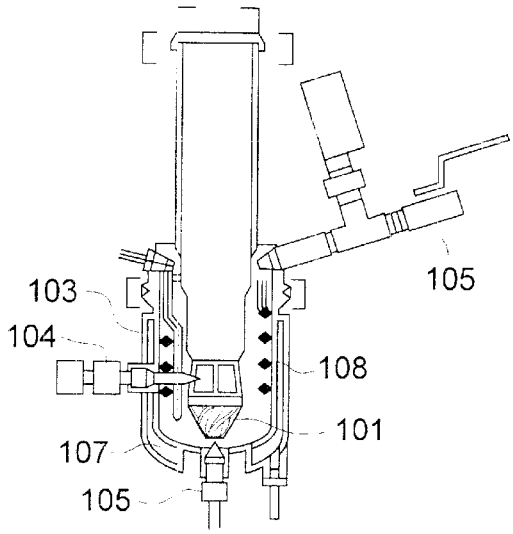
FIG. 9 ( c )
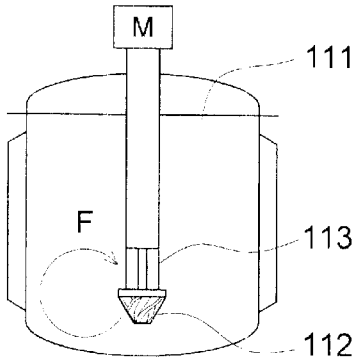

TONER FOR DEVELOPING STATIC IMAGE AND AN IMAGE FORMING METHOD

FIELD OF THE INVENTION

This invention relates to a toner for developing a static image to be used for a copying machine or a printer, a method producing the toner, and an image forming method using the toner.

BACKGROUND OF THE INVENTION

Recently, a digital image formation system become to the main current in image forming method by electron-microscopic photography. The image forming method by the digital system is based on the technique to make appear a small dot image of pixel having a size such as 1200 dpi, number of dot per inch, so a high quality image technique to reproduce the small dot with a high fidelity is required. The minimization of the toner particle diameter is proceeded from such the viewpoint.

A polymerized toner produced by a suspension polymerization or an emulsion polymerization has been noticed as a means for making small the toner particle diameter and for unifying the size distribution and the shape of the toner particles. Japanese Patent Publication Open to Public Inspection, hereinafter referred to as JP O.P.I., No. 2000-214629 discloses that the toner produced by the polymerization method can be controlled in the shape, roundness and the size distribution thereof.

A heat-roller fixing method is widely applied as a method for fixing a toner image formed on an image forming support such a sheet of paper by which the image forming support on which a toner image is formed is passed between a heating roller and a pressure roller to fix the toner image. The heat-roller method has a drawback such that an image contamination tends to be occurred by an off-set phenomenon which is caused by adhesion of the melted toner onto the heating roller.

It has been known as a means for prevent the occurrence of the off-set phenomenon that the heating roller of the fixing device is coated with silicone oil to give a mold-releasing ability to the roller. This method is advantageous since there is no limitation on the kind of the toner. However, the method is not suitable for business use because writing by a ball-point pen on the support paper is made difficult by adhesion of the silicone oil on the paper. In the market, the copied document is directly used as a business document and the writing on the document is usually required. Accordingly, the method of silicone coating is becoming one not satisfying the requirement at the present time.

For responding to such the requirement, a technique is applied by which a mold-releasing agent such as a wax is added into the toner itself for providing the mold-releasing ability. JP O.P.I. No. 3-296067 discloses a toner in which polypropylene as the mold-releasing agent is dispersed in the binder polymer to form a domain-matrix structure at the cross section of the toner, and the largest length of the domain of the polypropylene in the major axis direction and the average distance of the space between the domains are specified. JP O.P.I. No. 10-161338 discloses one having the domain-matrix structure in which the domain diameter of the mold-releasing agent before the heat fixation is specified and the domain-matrix structure is disappeared after the fixation.

However, a cleaning mechanism is necessary even when the mold-releasing agent is introduced in the reason of that an off-set phenomenon so called as a invisible off-set is caused by accumulation of the toner onto the fixing roller after a lot of image forming operations such as a number of ten thousands to twenty thousands even though the off-set is not occurred when several copies are made. The cleaning member of the fixing device should be changed every several ten thousands times of copying.

Besides, a high speed machine capable of outputting 50 or more sheets per minute is appeared on the market accompanied with rising of the processing ability of the image forming machine. In such the machine, the mold-releasing agent contained in the toner cannot sufficiently functions since the fixing process is finished before sufficient penetration of the mold-releasing agent to the toner surface. Thus the invisible off-set is easily occurred and the off-set occurred at a stage after a little number of copying.

Moreover, the toners disclosed in the above publications are produced by a crushing method with a kneading process, and the domain of the mold-releasing agent is oriented in one direction, so called orientation, in the toner particle in the course of the kneading process. When the mold-releasing agent is oriented in the toner, the effect of the mold-releasing agent between the fixing roller and the image receiving paper is difficultly appeared since the penetration of the mold-releasing agent in all directions cannot be occurred because the penetrating direction of the mold-releasing agent is decided according to the oriented direction thereof. As mentioned above, any toner usable in the high speed machine can not be obtained by the crushing method.

The effort to make smaller the toner diameter is proceeded from the view point of the rising of image quality, and the improvement of the compound for mold-releasing agent and a technique for increasing the adding amount of the mold-releasing agent into the toner have been studied as is shown in JP O.P.I. No. 8-41468. However, problems such as the mold-releasing agent released from the toner causes degradation of the developer, lowering of the fluidity of the toner and occurrence of the filming by the reason of the structure of the toner that the toner particle is composed of a resin particle and a mold-releasing agent particle.

JP O.P.I. No. 5-88409 discloses a toner particle having a specified structure. The disclosed toner is a polymerized toner having a large spherical domain of the mold-releasing agent in a binder resin. However, a particle containing no domain of the mold-releasing agent is found in such the toner since the problem of the partial distribution of the amount of the mold-releasing agent in each of the individual particle is not solved. Moreover, degradation of the toner such as lowering of the charging ability is caused by the mold-releasing agent released from the toner particle because the contacting area between the mold-releasing agent and the resin is decreased since the shape of the mold-releasing agent in the toner particle has a spherical shape.

The toners described in the above publications have a problem that the layer of the mold-releasing agent between the fixing roller and the toner cannot be sufficiently formed since a time is necessary for penetrating out the mold-releasing agent until the toner surface because only one or two large domains of the mold-releasing agent is existed near the center of the toner particle. As above-mentioned, development of a toner suitably used in the high speed image forming machine is desired.

SUMMARY OF THE INVENTION

The first object of the invention is to provide a toner for developing a static image, which is excellent in the resistivity against the invisible off-set and forms no image contamination even when the total number of the processed image is increased accompanied with the prolongation of the using period.

The second object of the invention is to provide a toner for developing a static image excellent in the fusibility and the fluidity, in which the penetration of the mold-releasing agent to the toner surface is effectively performed so that the wind-jamming in the fixing process caused by the shortage of the mold-releasing agent is not occurred.

The third object of the invention is to provide a toner for developing a static image having a high durability in which the mold-releasing agent is not released from the toner.

The fourth object of the invention is to provide a toner for developing a static image usable for a high speed image forming apparatus having a fixing process without oiling/cleaning.

The fifth object of the invention is to provide an image forming method using the foregoing toner.

The inventors noticed on the structure of the polymerized toner having the domain-matrix structure obtained by association of a resin particle according to the invention and a particle of a crystalline substance, and found that the objects of the invention can be attained by specifying the shape and the dispersed state of the crystalline substance in the toner particle. Namely, in the invention, it is found that the objects of the invention is attained by that the shape of the crystalline substance in the toner particle is made to elliptical and the elliptical shaped crystalline substance is randomly dispersed without orientation.

In the invention, it is found that the wax is uniformly and suitably penetrated out from the toner even if the toner particle is pressed from any direction at the time of the fixing, when the crystalline substance forming the domain is suitably dispersed in the three dimensional arrangement without uneven distribution in the toner particle having the domain-matrix structure. Thus the effects such as the off-set prevention are realized.

In the invention, the toner particle is prepared in any portion of which the domain is equally dispersed, besides a toner including a portion at which the domains are densely dispersed in a state having a extremely small distance between the domains and another portion at which the domains are sparsely dispersed is not formed. The present invention and its embodiments are described below.

A toner for developing a static image comprising at least a resin, colorant and a crystalline substance, wherein the toner particle has a domain-matrix structure and the domain has an average of the ratio of the major axis to the minor axis of from 1.15 to 2.5 when the domain is approximated by an ellipse.

A toner for developing a static image comprising at least a resin, colorant and a crystalline substance, wherein the toner particle has a domain-matrix structure and the distribution of the angle of the major axis of the ellipse with the X axis optionally set on the electron microscopic photograph has two or more peaks when the domain is approximated by an ellipse.

A toner for developing a static image comprising at least a resin, colorant and a crystalline substance, wherein the toner particle has a domain-matrix structure and the distribution of the angle of the major axis of the ellipse with the X axis optionally set on the electron microscopic photograph has no peak when the domain is approximated by an ellipse.

The toner for developing a static image comprising at least a resin, colorant and a crystalline substance, wherein the toner particle has a domain-matrix structure and the domains are different in the luminance.

The toner described above, wherein the toner particle has a domain-matrix structure comprising a matrix of the resin, the domain of the colorant and an domain of the crystalline substance.

The toner described above, wherein the toner particle has a domain-matrix structure and an extract solution of the crystalline substance has a spectral transmittance of from 70.0 to 99.5%.

The toner described above, wherein the ratio of the particles having no corner is not less than 50% in number and a number variation coefficient in the particle size distribution in number is not more than 27%.

The toner described above, wherein the ratio of the toner particles having a shape coefficient of from 1.2 to 1.6 is not less than 65% in number and a number variation coefficient in the particle size distribution in number is not more than 27%.

The toner described above, wherein the toner has a number average particle diameter of from 3 to 9 $\mu$m.

The toner described above, wherein the sum M of a relative frequency m1 of the toner particles contained in the highest frequency class and a relative frequency m2 of the toner particle contained in the next high frequency class in a histogram of the particle size distribution in number is not less than 70%, in the histogram, natural logarithm of log D of the diameter of the toner particle D is graduated on the horizontal axis and toner particle size is classified by every 0.23 on the horizontal axis.

The toner described above, wherein the toner particle is produced by polymerizing at least a polymerizable monomer in an aqueous medium.

The toner described above, wherein the toner particle is produced by coagulating and melt-adhering particles of the resin.

The toner described above, wherein the toner is produced by salting/melt-adhering a colorant particle and a combined fine particle of a resin prepared by dissolving the crystalline compound in a polymerizable monomer and then polymerizing the polymerizable monomer.

The toner described above, wherein the toner is produced by salting/melt-adhering a colorant particle and a combined fine particle of a resin prepared by a poly-step polymerization method.

The toner described above, wherein the toner is produced by adhering a resin layer by a salting/melt-adhering method on the surface of a resin particle and a colorant particle.

A method for producing a toner for developing a static image comprising at least a resin, colorant and a crystalline substance whereby the toner described in any one of the foregoing 1 through 15 is produced.

An image forming method comprising the steps of visualizing a static image formed on a photoreceptor, transferring the visualized image onto a recording medium, and fixing by heating the image, wherein the fixing is performed at a line speed of from 230 to 900 mm/sec, and the visualization is performed by the use of the toner described above.

The image forming method described above which comprises the steps of visualizing a static image formed on a photoreceptor, transferring the visualized image onto a recording medium, and, fixing by heating the image, wherein light exposed to the photoreceptor is performed by digitalized exposure.

A toner described above, wherein the DSC curve of the toner has an endothermic peak within the range of from 60 to 110° C. and an endotherm quantity of from 4 to 30 j/g, the toner particle has a domain-matrix structure in which the average of the smallest distance between the walls of the domains is from 100 to 1060 nm, and domains each has the smallest distance between the wall of the neighbor domain of not less than 1300 nm account for not more than 10% in number of the whole domains.

A toner described above wherein the DSC curve of the toner has an endothermic peak within the range of from 60 to 110° C. and an endotherm quantity of from 4 to 30 j/g, the toner particle has a domain-matrix structure in which the average of the smallest distance between the walls of the domains is from 260 to 820 nm, and domains each has the smallest distance between the wall of the neighbor domain of not less than 1300 nm account for not more than 4% in number of the whole domains.

A toner described above wherein the toner particle has a domain-matrix structure and the number of the domain exposed at the surface of the toner particle is zero.

A toner described above wherein the toner particle has a domain-matrix structure, and the average area of Voronoi polygons each formed by lines each perpendicularly and equally dividing the line connecting between the gravity centers of the neighbor domains is from 20,000 to 120,000 $nm^2$ and the variation coefficient of the area of the Voronoi polygon is not more than 25%.

A toner described above wherein the toner particle has a domain-matrix structure, and the average area of Voronoi polygons each formed by lines each perpendicularly and equally dividing the line connecting between the gravity centers of the neighbor domains is from 40,000 to 100,000 $nm^2$ and the variation coefficient of the area of the Voronoi polygon is not more than 20%.

A toner described above wherein the toner particle has a domain-matrix structure, and the average area of Voronoi polygons each formed by lines each perpendicularly and equally dividing the line connecting between the gravity centers of the neighbor domains is from 20,000 to 120,000 $nm^2$, and the domains each having the Voronoi polygon having an area of not less than 160,000 $nm^2$ account for from 3 to 20% in number.

A toner described above wherein the toner particle has a domain-matrix structure, and the average area of Voronoi polygons each formed by lines each perpendicularly and equally dividing the line connecting between the gravity centers of the neighbor domains existing outside of a circle having radius of 1,000 nm and the center at the gravity center of the cross section of the toner particle is larger than the average area of Voronoi polygons each formed by lines each perpendicularly and equally dividing the line connecting between the gravity centers of the neighbor domains existing inside the circle.

A toner described above wherein among Voronoi polygons each formed by lines each perpendicularly and equally dividing the line connecting between the gravity centers of the neighbor domains, exist from 5 to 30 domains having the Voronoi polygon which contact with the outside of the toner particle and has an area of not less than 160,000 $nm^2$.

A toner described above wherein the domains include domains different in the luminance from each other.

A toner described above wherein the matrix is constituted by the resin and the domains constituted by the domain of the crystalline substance and the domain of the colorant.

BRIEF DESCRIPTION OF THE DRAWING

FIG. 1(*b*) is a schematic view explaining a toner particle comprised of a domain-matrix structure falling outside of the present.

FIGS. 9(*a*) through (*c*) show cross-sectional view of mixing machine employed for the preparation of toner of the invention.

DETAILED DESCRIPTION OF THE INVENTION

Figure 1:
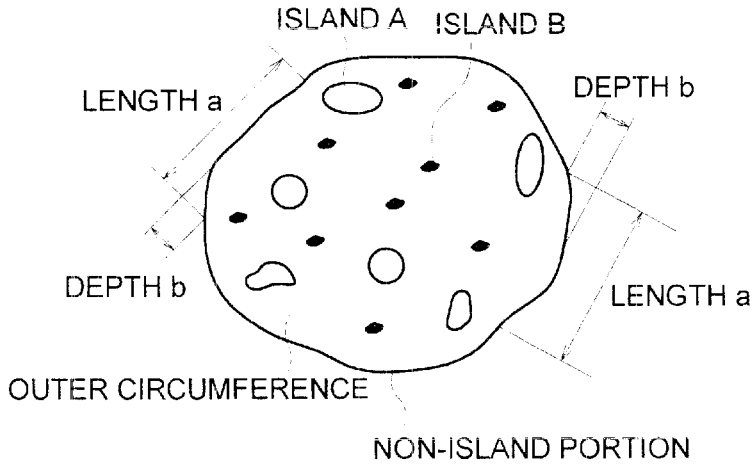
FIG. 1(*a*) is a schematic view explaining a toner particle comprised of a domain-matrix structure of the present invention.
Figure 1:
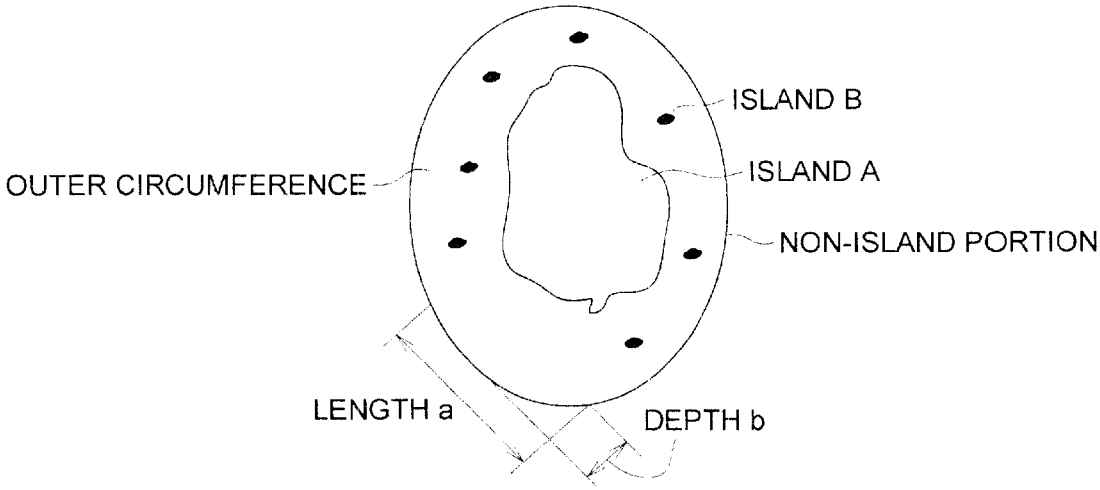

The toner according to the invention is a polymerized toner having the domain-matrix structure. The domains of the crystalline substance in the toner particle each has an ellipse shape and are randomly arranged in the particle and not oriented in a specified direction. The domains are uniformly dispersed in each of the particles without uneven distribution. The toner particle having the domain shape and the dispersion state found by the invention cannot be obtained at all until the present time.

In the invention, it is become possible that the crystalline substance having the mold-releasing ability contained in the toner particle is uniformly penetrated in all directions and amount with no relation to the pressure direction applied at the time image formation. As a result of that, the effects such as the prevention of occurrence of the off-set and the uneven glossiness are realized.

The invention is described in detail below.

The toner particle according to the invention has the domain-matrix structure. The domain-matrix structure is a structure in which a domain phase having a closed interface or the interface between the phase and another phase, in a continuous phase. In the toner according to the invention, the resin, the colorant and the crystalline substance constituting the toner particle are not dissolved with together and independently form individual phase. Therefore, the domain-matrix structure is formed in the toner particle. In the invention, the domain of the crystalline substance and that of the colorant are existed in the continuous phase of the resin as the matrix so as to satisfy the property of the toner.

As above-mentioned, the toner particle according to the invention has the structure in which the phase of the crystalline substance and the phase of the colorant are existed in the form of domain in the continuous phase. It is found that the amount of the crystalline substance released from the toner particle can be considerably reduced when the ratio of the major axis to the minor axis of the ellipse approximating the domain of the crystalline substance constituting the toner particle is within a specified range. As a result of that, the function of the crystalline substance contained in the toner particle is effectively realized so that the foregoing objects of the invention such as improvement of the fixing property, for instance, the invisible off-set and the inhibition of filming, can be attained.

In the conventional technique, the crystalline substance added to the polymerized toner tends to be released from the toner particle. Such the problem is solved by the invention. In the invention, the reason of the effective prevention of the release of the crystalline substance is not cleared completely yet. It may be presumed, however, that in the toner according to the conventional technique, the crystalline substance added in the toner particle is easily moved in the toner particle since the shape of the particle of the crystalline substance is spherical or near spherical, or the contact area of the crystalline substance in the toner particle is small and the crystalline substance particle cannot be strongly held in the toner particle since the shape of the particle of the crystalline substance is spherical or near spherical. Accordingly, the crystalline substance is fallen off from the toner particle.

Contrary to that, as to the toner according to the invention, the crystalline substance is not released from the toner particle and is stably and strongly held in it except the time of fixing since the shape of the domain of the crystalline is suitable to be strongly held in the toner particle, thus the problem of filming on the photoreceptor is solved. Accordingly, it is presumed that the function to rapidly and certainly penetrate the crystalline substance at the time of fixing is given to the toner particle. Moreover, a protective layer having a low frictional coefficient is formed on the surface of the fixed image by the crystalline substance having the mole-releasing function which is effectively penetrated out from the toner particle. The problem of the accumulation of the contamination on the image forming apparatus is solved by the formation of the crystalline substance protective layer. Particularly, the fixing property such as the resistivity against the invisible off-set is considerably raised.

The toner particle according to the invention has the structure in which the domain constituted by a phase of constituting component is contained in the continuous phase constituted by another component. In the invention, the dispersing state of the domains of the crystalline substance is controlled and the amount of the crystalline substance releasing from the toner particle is considerably reduced by specifying the number of the domains having the smallest interwall distance within a specified value. As a result of that, the foregoing objects such as the prevention of occurrence of filming on the photoreceptor is attained by that the crystalline substance added to the toner particle effectively function at the time of the image formation.

In the conventional technology, it is difficult to suitably disperse the crystalline substance added into the polymerized toner. Such the problem is solved by the invention. It is not completely cleared yet why the uniform and suitable dispersion of the crystalline substance in the toner particle can be attained in the invention. It may be supposed that the domain in the suitable dispersion state cannot be formed in the toner particle according to the conventional technology since the particles of the crystalline substance further tend to be coagulated with together. In the invention, it is supposed that such the problem is solved by effectively realizing the mechanism for inhibiting the coagulation of the crystalline substance.

It is considered in the invention that the release of the crystalline substance from the toner particle is also prevented by that the crystalline substance is uniformly dispersed in the toner particle without exposing at the toner surface. It is not completely cleared why the toner particle having such the structure can be produced. It may be supposed that the crystalline substance having the mold-releasing ability using in the toner according to the invention can be held in the binder resin in a more stable state by existing at the interior of the toner particle.

If the crystalline substance is existed on the surface of the toner particle, the crystalline substance may be removed together with water at the time of removing the aqueous medium in the filtering process of the toner since the toner is heated at a temperature higher than the melting point of the crystalline substance in the producing process thereof.

It may be presumed that such the result is obtained by the shape of the crystalline substance. Namely, in the toner according to the conventional technique, the crystalline substance added and coagulated in the toner particle is easily moved in the toner particle since the shape of the particle of the crystalline substance is spherical or near spherical, or the contact area of the crystalline substance in the toner particle is small and the crystalline substance particle cannot be strongly held in the toner particle since the shape of the particle of the crystalline substance is spherical or near spherical. The crystalline substance, therefore, is fallen off from the toner particle.

It can be confirmed by the cross section photograph taken by an transmission electron microscope that the toner particle according to the invention has the domain-matrix structure since regions each different in the luminance thereof are in the toner particle. Namely, it is confirmed by the electron-microscopic photograph that particular-shaped domains each different in the luminance, the phase of the crystalline substance and the phase of the colorant, are in the continuous phase or the phase of the binder resin. The domains existing in the toner particle is approximated by an ellipse according to the observation of the electron-microscopic photograph, and the ratio of the major axis to the minor axis and the angle of the major axis of the ellipse with the direction optionally set on the cross section photograph are determined.

The luminance of the transmission electron-microscopic photograph is formed by visualizing the difference of the electron transmission caused by the difference of the crystallizing states of the binder resin, the colorant and the crystalline substance. The colorant is generally taken as a low luminance image since the electron transmittance of the colorant is lower than that of the binder resin, and the crystalline substance is taken as an image with a higher luminance rather than that of the binder resin.

In the electron-microscopic photograph, the pixel classified into a grade within the range of from 0 to 99 is defined as the low luminance and the pixel classified into a grade within the range of from 80 to 160 is defined as the medium luminance and the pixel classified into a grade within the range of from 127 to 255 is defined as the high luminance when the luminance signal of the pixel is classified in 256 grades. However, in the invention, the grade may be a relative value by which the component of the toner particle can be distinguished on the photograph, and is not limited by the above-mentioned value. For example, the domain of the crystalline substance can be observed as a hole when the slice for transmission electron microscopy is stood under a condition of a temperature of from 80 to 120° C. to carry away the crystalline substance. Thus the domain of the crystalline substance can be easily distinguished from the domain of the colorant.

The matrix and the domain can be visually distinguished on the electron-microscopic photograph by distinguishing the each component in the toner particle based on the luminance of the individual component. The distinguishing is performed by converting the luminance information to the image information capable of being visually distinguished by an image analyzing apparatus attached to the electron microscope.

FIGS. 1(*a*) and 1(*b*) are each a schematic drawing of an example of toner particle having the domain-matrix structure. It is observed on the electron-microscopic photograph that the toner particle according to the invention is constituted by the continuous phase and the domain having a luminance different from that of the continuous phase. Moreover, a portion with a length a and a deepness b containing no domain exists along the circumference of the toner particle.

In the invention, the crystalline substance constituting the domain is an organic compound having a melting point, preferably a carbon hydride compound containing an ester group in the chemical structure thereof. The melting point of the crystalline substance in the toner particle according to the invention is lower than the softening point of the toner, concretely not more than 130° C. It is preferable that the organic compound has an ester group. The example thereof includes a crystalline polyester compound.

In the toner according to the invention, it can be confirmed by DSC that the crystalline substance constituting the domain has the melting point. Moreover, it can be confirmed by a means such as a X-ray diffraction apparatus that the substance is crystallizable. The crystalline substance contained in the toner according to the invention includes one capable of functioning as the mold-releasing agent.

The melting point of the crystalline substance is preferably from 50 to 130° C., more preferably from 60 to 120° C. The viscosity of the melted toner can be lowered by the crystalline substance having a melting point within the range of from 50 to 130° C. so as to improve the adhesiveness of the toner to paper. Moreover, a suitable off-set resistivity is realized since the elastic modulus in the high-temperature range is held within a preferable level even when the crystalline substance is existed.

The melting point of the crystalline substance is a value measured by a differential thermal analyzing apparatus (DSC). In concrete, the temperature is defined as the melting point, at which the maximum endothermic peak measured by raising the temperature of the substance from 0° C. to 200° C. in a rate of 10° C./min, the first temperature raising process, is observed. The melting point is equal to the latter-mentioned "the endothermic peak P1 in the first temperature raising process by DSC".

Concrete example of the measuring apparatus includes DSC-7 manufactured by Parkin-Elmer Co., Ltd. The concrete measuring procedure by the differential thermal analyzing apparatus DSC is as follows:

The sample to be measured is stood at 0° C. for 1 minute and then heated by 200° C. in the rate of 10° C./min. The temperature at which the maximum endothermic peak is observed in the course of the foregoing process is defined as the endothermic peak P1 in the first temperature raising process.

Then the sample is stood at 200° C. for 1 minute and then cooled in the rate of 10° C./min. The temperature at which the maximum exothermic peak is observed in the course of the foregoing cooling process is defined as the exothermic peak P2 in the first cooling process.

The crystalline substance to be used in the toner according to the invention is preferably one having an endothermic peak P1 in the first temperature raising process by DSC of from 50 to 130° C., particularly from 60 to 120° C. Moreover, it is preferable that the exothermic peak P2 in the first cooling process by DSC is from 30 to 110° C., particularly from 40 to 120° C. Here, the endothermic peak P1 and the exothermic peak P2 have a relation of $P1 \geqq P2$. The difference of the temperature P1−P2 is preferably not more than 50° C. even though there is no specific limitation.

An excellent off-set preventing effect or a wide fixing temperature range and an excellent fixing ability or a high fixing ratio can be obtained by containing the crystalline substance having the foregoing thermal property. It is preferable for displaying the effect of the invention that the binder resin and the crystalline substance are each existed in the state of the separated phase.

The crystalline substance which is sharply melted causes the lowering of the melt-viscosity of the whole toner and the fixing ability of the toner can be improved. The resistivity against the off-set is not degraded since lowering in the elastic modulus in the high-temperature range can be inhibited by the state in which the crystalline substance and the binder are in the separated phase from each other.

The toner according to the invention preferably has an endothermic peak within the range of from 60° C. to 110° C. in the DSC curve and an endotherm of from 4 to 30 J/g. It is confirmed by DSC that the crystalline substance constituting the domain in the toner according to the invention has a melting point. Moreover, it is confirmed by a means such as an X-ray diffractometer that the crystalline substance has a crystallinity. The crystalline substance to be contained in the toner according to the invention includes one capable of functioning as the mole-releasing agent at the time of image formation.

Both of the confirmation of the endothermic peak and the determined of the quantity of the endotherm can be carried out by the differential thermal analyzer (DSC). The toner according to the invention preferably has an endotherm quantity of from 4 to 30 j/g, more preferably from 6 to 24 j/g, at the endothermic peak.

In the invention, the domain part in the toner particle is approximated by an ellipse and the shape and the dispersed state of the domain are specified by the ratio of the major to minor axis and the angle of the ellipse. The specification of the domain in the toner particle is based on the image information taken by the transmission electron-microscopic photograph of the toner particle.

In the invention, 50 fields are photographed with a magnitude of 10,000 times using a transmission electron microscope LEM-2000 manufactured by Topcon Co., Ltd., and the shape and the dispersed state of the domain in the toner particle are specified base on the observation results as to 1,000 or more particles. The procedure is described below.

The shape of the domain is approximated to the ellipse shape and the ratio of the major axis to the minor axis of the ellipse is calculated by the foregoing image processing apparatus. The shape of the domain is converted to the ellipse in the image processing apparatus by the following procedure.

First, X-axis and Y-axis crossing with each other at a right angle are set on the transmission electron-microscopic photograph and the coordinates of the domain in the toner particle is determined.

Figure 2:
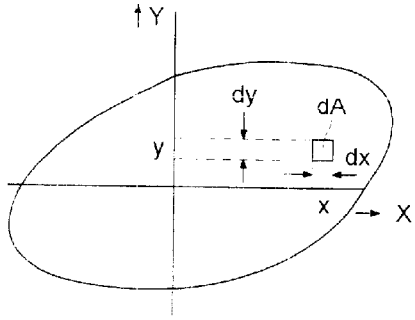
FIG. 2 is a schematic view of a toner particle to explain the calculation of moment of the toner.

The lightness or luminance of the image versus the X-axis and the Y-axis is converted to an image moment. In the image moment, the luminance of the image is considered as the weight. As is shown in FIG. 2, when the luminance of the image at coordinates (x, y) having an infinitesimal area dA is presumed f(x, y), it can be considered that the f(x, y)dA corresponds to the weight used in the dynamics. The f(x, y)dA is multiplied by n power of distance from an axis, e. g. the distance from X-axis is y, and integrated as to the area A. Thus obtained $\int f(x, y)y^n dA$ is called as the n-degree moment.

Moment in a digital image is given by replacing the integral symbol by summation symbol:

$$M_{pq}=\Sigma\Sigma x^p y^q f(x,y).$$

The 1-degree moment of the X-axis $m_{01}$ and Y-axis $m_{10}$ and the 0-degree $m_{00}$ moment are defined as follows, and the coordinates of the gravity center of the domain are calculated.

The 1-degree moment as to the X-axis $m_{01}=\Sigma\Sigma y\cdot f(x, y)$

The 1-degree moment as to the Y-axis $m_{10}=\Sigma\Sigma x\cdot f(x, y)$

The 0-degree moment $m_{00}=\Sigma\Sigma f(x, y)$

In the above, the 0-degree moment represents the sum of the image density, and the area of the subject, the domain in the invention, when the image is a binary image.

According to the above definition, the gravity center coordinates $X_g$ and $Y_g$ are defined as follows: The gravity center coordinates $X_g$ $$X_g=m_{10}/m_{00}=\text{1-degree moment } Y,$$

and the gravity center coordinates $Y_g$ $$Y_g=m_{01}/m_{00}=\text{1-degree moment X.}$$

Moreover, the major axis length and the minor axis length of the ellipse are determined from the 2-degree moments $M_{02}$ and $M_{20}$ affecting around the gravity center of the domain and the inertia synergistic moment $M_{11}$. The inertia synergistic moment represents the sum of the image density at the gravity center. The 2-degree moments affecting around the gravity center of the domain and the inertia synergistic moment are as follows:

The 2-degree moment as to the X-axis $$M_{02}=\Sigma\Sigma(y-Y_g)^2\cdot f(x,y)$$

The 2-degree moment as to the Y-axis $$M_{20}=\Sigma\Sigma(x-X_g)^2\cdot f(x,y)$$

The inertia synergistic moment $$M_{11}=\Sigma\Sigma(x-X_g)(y-Y_g)\cdot f(x,y)$$

When the domain in the toner particle according to the invention is an ellipse on the two-dimensional plane, the ellipse is defined as follows:

$$\text{Equation of the ellipse } AX'^2+BY'^2=1$$

In the above, A and B are each the inertia moment as X' and Y', respectively. X' and Y' represent the main axis of the inertia, namely the main axis of the ellipse.

Accordingly, the inertia moment A as the major axis of the ellipse is defined as follows:

$$A=M\theta\max=[\tfrac{1}{2}(M_{02}+M_{20})\pm\tfrac{1}{2}\{(M_{02}-M_{20})^2+4M^2_{11}\}^{1/2}]\max$$

In the above, M represents the moment around the gravity center, θmax is an angle of the major axis with X-axis which angle gives maximum inertia moment, and θmin is an angle of the minor axis with X-axis which angle gives minimum inertia moment.

The major axis 2a is defined as follows:

$A=1/a^2=M\theta\max$ $a^3=1/M\theta\max$ $a=(1/M\theta\max)^{1/2}$

The inertia moment B as the minor axis of the ellipse is as follows:

$$B=M\theta\min=[\tfrac{1}{2}(M_{02}+M_{20})\pm\tfrac{1}{2}\{(M_{02}-M_{20})^2+4M^2_{11}\}^{1/2}]\min$$

The minor axis 2b is defined as follows:

$B=1/b^2=M\theta\min$ $b^2=1/M\theta\min$ $b=(1/M\theta\min)^{1/2}$

The foregoing processing is performed by the image processing apparatus attached to the transmission electron microscope to convert the domain in the toner particle to the ellipse and specify the angle as the means for specifying the dispersed state of the domain. The ratio of the major axis to the minor axis a/b of the ellipse is defined by the followings:

$a/b$=(the major axis $a$ of the ellipse after conversion)/(the major axis $b$ of the ellipse after conversion)

In the toner according to the invention, the average of the ratio of the major axis to the minor axis of the ellipse is within the range of from 1.15 to 2.5, preferably from 1.35 to 2.05, more preferably from 1.5 to 1.7. The value of the ratio of the major axis to the minor axis of the ellipse is calculated based on the statistically significant number of the domains such as 1,000.

The angle of the ellipse θ is an angle of the major axis of the ellipse approximated to the domain by the foregoing procedure with the X-axis optionally set on the electron-microscopic photograph. The angle of the major axis of the ellipse with the X axis represents the direction of the main axis of the moment, and θ is defined by the following equation.

$$\theta=\tfrac{1}{2}[\tan^{-1}(2M_{11}/(M_{20}-M_{02}))]-\pi/2\leqq\theta\leqq\pi/2$$

Here, the direction of the axis at which the inertia moment becomes to largest is defined as the major axis although the main moment axis included the maximum one and the minimum one. When the inertial moment after the axis is rotated around the gravity center so the θ is become to the positive direction of the X-axis, is presume as $M'_{20}$, $$M'_{20}=\tfrac{1}{2}[(M_{20}+M_{02})+(M_{20}-M_{02})\times\{(2M_{11}^2/(M_{20}-M_{02}))+1\}^{1/2}]$$

The inertia moment becomes the same as the major axis or the minor axis of the foregoing ellipse when the main axis of the inertia is the X axis.

The inertia moment $M'_{02}$ in the direction of the minor axis at which the inertia moment becomes minimum is represented as $M'_{02}=M_{20}+M_{02}-M'_{20}$. Here, the inertia moment the X-axis direction $M_{11}$ becomes 0 since the axis the gravity center is rotated.

As the results of the above, the θ as the direction of the major axis, in such the direction the inertia moment becomes maximum, is as follows according to the inertia moment;

$$0 \text{ when } M'_{20}\geqq M'_{02}$$

and $$\theta+\pi/2 \text{ when } M'_{20}<M'_{02}.$$

Thus obtained angle represented by θ is:

(1) The case of the angle based on the X-axis, $$0 \leqq \theta \leqq \pi/4 \text{ when } M_{20}-M_{02} \geqq 0 \text{ and } M_{11} \geqq 0,$$

$$-\pi/4 \leqq \theta \leqq 0 \text{ when } M_{20}-M_{02} \geqq 0 \text{ and } M_{11} < 0.$$

(2) The case of the angle based on the Y-axis, $$0 \leqq \theta \leqq \pi/4 \text{ when } M_{20}-M_{02} < 0 \text{ and } M_{11} < 0,$$

$$-\pi/4 \leqq \theta \leqq 0 \text{ when } M_{20}-M_{02} < 0 \text{ and } M_{11} \geqq 0.$$

In the invention, it is preferable that the distribution of the angle θ has no or two or more peaks, the angle θ is an angle of the major axis of the ellipse obtained by approximation of the domain of the crystalline substance to the X axis optionally set on the electron-microscopic photograph. The number of peaks is preferably from 2 to 10. The peak of the distribution of the angle θ of the domains of crystalline substance in the toner particle according to the invention is defined as follows: a histogram of the angle of the ellipse is prepared in which the angle θ is classified into 36 classes by every 5° within the range of from −90° to 90°, and the peak is acknowledged when the difference of the angles between the highest frequency class and the next high frequency class is 10° or more.

The structure of the toner particle according to the invention can be sufficiently observed by the transmission electron microscope well known in the field of the technology such as ELM-2000 manufactured by Topcon Co., Ltd. In the invention, the specific value such as the number of the domain in the toner particle is determined based on 1,000 or more particles of the toner photographed with a magnitude of 10,000 times.

The photographing by the electron microscope is performed in the conventional manner for observing the toner particle. The cross-section of the toner particle may be concretely measured in the following manner:

The toner particle is sufficiently dispersed in epoxy resin hardenable at an ordinary temperature and embedded in the resin by hardening, or the toner is dispersed in a fine powder of styrene resin having a particle size of about 100 nm and pressed to formed a block, and the block is dyed by triluthenium tetraoxide or triosmium tetraoxide or a combination thereof, according to necessity, and the block obtained by the foregoing procedure is sliced by a microtome having a diamond cutting edge to prepare a thin sliced sample.

The sliced sample thus prepared is photographed by the transmission electron microscope to take a photograph of the cross-section of the toner particle. The state of the area of the crystalline substance in the toner particle is visually confirmed and the values of FERE diameter, number and shape coefficient of the domain is obtained by processing the image information of the taken photograph by the use of an image processing apparatus Lusex F, manufactured by Nicole Co., Ltd., attached with the electron microscope.

Practically, the toner particle to be photographed is embedded in light-hardenable resin and sliced by a microtome Ultracut E, manufactured by Reichert-Jung Co., Ltd. Thus obtained slice is photographed by the transmission electron microscope LEM-2000 manufactured by Topcon Co., Ltd. The shape and the dispersed state of the domain can be qualitively confirmed by thus taken photography, and the dispersed state of the domain in the toner particle can be numerically represented by approximating the domain shape by an ellipse by the use of an image processing apparatus Lusex F manufactured by Nicole Co., Ltd. and calculating the ratio of the major axis to the minor axis and the angle distribution of the ellipse.

When the number of the peak in the histogram of the angle of the major axis of the ellipse to the X-axis optionally set on the electron-microscopic photograph is one, the domains tend to be oriented in a specific direction. Such the state is not preferred in the invention since the effect of the invention is difficultly realized.

The structure of the toner particle according to the invention is specified by the foregoing procedure. The factors specifying the structure of the toner particle according to the invention is described below.

In the toner particle according to the invention, the average value of the smallest interwall distance of the domains is within the range of from 100 to 1060 nm, and the domains having the smallest interwall distance of not less than 1300 nm account for not more than 10% in number of the whole toner particle. The domains constituted by crystalline substance are uniformly and finely dispersed having a suitable short distance in the toner particle satisfying the above-mentioned condition. It is visually confirmed on the foregoing transmission electron-microscopic photograph that the domains are finely dispersed without scattering of the distance in the toner particle of the invention.

In the toner particle of the invention, the condition that the average value of the smallest interwall distance of the domains is within the range of from 100 to 1060 nm, and the domains having the smallest interwall distance of not less than 1300 nm account for not more than 10% in number of the whole domains in the toner particle means that there is no unevenness of the dispersion of the domain in the particle, for instance, there are a portion in which many domains are excessively crowded and another portion in which almost no domains is contained. In the invention, it is confirmed that the domains are dispersed in the suitable state without unevenness in the toner particle.

In the invention, the smallest interwall distance is defined by the distance between the interfaces of the neighbor domains in the toner particle as is shown by the arrow in the schematic drawing of FIG. 1(*a*).

When the average value of the smallest interwall distance of the domains is within the range of from 260 to 820 nm, and the domains having the smallest interwall distance of not less than 1300 nm account for not more than 4% in number of the whole domains in the toner particle, the dispersed state of the domains in the toner particle is further raised so as to attain the further effective penetration of the crystalline substance.

In the invention, the percentage of the domains having the smallest interwall distance of not less than 1300 nm may be of course zero. The state in which the percentage of the domains having the smallest interwall distance of not less than 1300 nm is course zero means that the domains are completely finely dispersed with a short distance, without unevenness.

It is preferable in the invention that 98% of the whole crystalline substance constituting the domain is not exposed to the surface of the toner particle when the average value of the smallest interwall distance of the domains is within the range of from 100 to 1060 nm, and the domains having the nearest interwall distance of not less than 1300 nm account for not more than 10% in number of the whole domains in the toner particle.

The domain is difficultly released from the toner particle when the domain is not exposed to the surface of the toner particle. It can be confirmed by analyzing the results of the observation on the foregoing transmission electron-microscopic photograph that the state of the domains exposed at the toner particle surface and the ratio of the domains which are not exposed at the surface of the toner particle is not less than 98%. The measurement is carried out based on the statistically significant number of the domains such as 1,000.

The toner particle of the invention has a domain of colorant easily distinguishable by the electron-microscopic photograph additionally the domain of the crystalline substance. The domain of the colorant is shown as domain B in FIG. 1(*a*). As is cleared by the schematic drawing, the toner particle may contain plural kinds of domains each constituted by the different constituting component respectively such as the domain of the crystalline substance and the domain of the colorant. These different kinds of the domain can be easily distinguish on the electron-microscopic photograph since their luminance are different from each other.

The domain B of the colorant component is specified by the area of the later-mentioned Voronoi polygon. The Voronoi polygon can be calculated by the image analyzing apparatus attached based on the image information observed by the transmission electron microscope in the same manner as in the case of the domain of the crystalline substance.

The area of the Voronoi polygon employed in the present invention, as described herein, refers to the domain portion occupying state in the toner particle. The Voronoi polygon or Voronoi polyhedron, as described herein, is as follows. As described in, for example, "Iwanami Rikagaku Jiten (Iwanami Physical and Chemical Dictionary)", when many points are scattered in a space or on a plane, the whole space or the whole plane is divided into polyhedrons or polygons by creating a perpendicular bisecting plane or a perpendicular bisecting line of the adjacent points. The polyhedron formed as above is called Voronoi polyhedron, while the polygon formed as above is called Voronoi polygon. Such division of said space as well as said plane is called Voronoi division. FIG. 2 shows one example of the toner particle of the present invention which is divided by a Voronoi polygons.

As described above, in the present invention, as the scale showing the domain portion occupying ratio in the toner particle, the domain portion occupying state in the domain-matrix structure of the toner particle is shown employing the area of the Voronoi polygon obtained by said Voronoi division. Namely, in the present invention, the center of gravity of the domain in the toner particle is focused on, and a polygon is formed employing a perpendicular bisecting line between the centers of gravity of adjacent domains. These polygon areas are calculated based on photographs obtained employing a transmission type electron microscope while employing the image analysis device installed in said transmission type electron microscope.

A large Voronoi polygonal area indicates that the distance between the centers of gravity of adjacent domains is large. Namely, it indicates that the domain portion occupying state of in the particle is not dense. On the other hand a small Voronoi area indicates that the distance between the centers of gravity of adjacent domains is short. Namely it indicates that the domain occupying state in the particle is in a dense state. In the present invention, the Voronoi polygons of 1,000 toner particles were determined and the average value were calculated.

Incidentally, the Voronoi polygon is generally and mathematically defined employing the formula described below.

<Area of Voronoi Polygon>

The set of Voronoi polygon V(i) regarding N independent point P(i) ($1 \leqq i \leqq N$) in two-dimensional space R2 or three-dimensional space R3 is:

$$V(i)=\{X \mid |X-P(i)|<X-P(j) \text{ for all } i \text{ and } j\}$$

wherein X and P each represent the position vector and || represents the distance in Euclidean space.

V(i) as defined above assumes that in R2, a Voronoi polygon is formed, and in R3, a Voronoi polyhedron is formed. When V(i) is directly adjacent to V(j), it is defined that the boundary between Voronoi polygons becomes one part of the perpendicular bisecting line connecting point P(i) with point P(j). Said Euclidean space equals one which is defined and described in "Suurikagaku Daijiten (Mathematical Science Encyclopedia)".

Further, the center of gravity of the toner particle of the present invention, as well as the center of gravity of each domain in the toner particle is obtained employing the moment of images, which is automatically calculated by the image analysis device installed in said transmission type electron microscope. Herein, the coordinates of the center of gravity of the toner particle are obtained as follows. The product of the luminance of a minute area at an optional point of the toner particle, and the coordinates of said optimal point are obtained. Further, regarding all the coordinates in which all toner particles exist, the product of the luminance and the coordinate values is obtained. Then, the coordinates of the center of gravity are obtained by dividing the sum of the resulting products by the luminance of the toner particle (the sum of the luminance at each coordinate point obtained as above). Further, the center of gravity of the domain is obtained in the same manner as above by obtaining the luminance at an optional coordinate point in the domain. As noted, the coordinates of the center of gravity of the toner particle of the present invention, as well as the coordinates of the of center of gravity of each domain in the toner particle are calculated based on the luminance at each of the optional points. Namely, said coordinates are calculated based on the brightness and darkness of images.

In the present invention, the average area of the Voronoi polygon formed by the perpendicular bisecting line between the centers of gravity of domains, which are directly adjacent to each other in the toner particle, is from 20,000 to 120,000 $nm^2$, and the variation coefficient of the average of said area is no more than 25 percent. The variation coefficient of the area of the Voronoi polygon in the present invention is calculated based on the formula below:

$$\text{variation coefficient of the area of the Voronoi polygon } (S1/K1)\times 100 \text{ (in percent)}$$

wherein S4 is the standard deviation of the area of the Voronoi polygon in the toner particle, and K4 is the average area of the Voronoi polygon.

Percentage of the domain having an average area of the Voronoi polygon formed by the perpendicular bisecting line between the centers of gravity of the domains, which are adjacent to each other in the toner particle of the present invention, is in the range of 20,000 to 120,000 $nm^2$ is preferably 3 to 20 by number among domain numbers in a toner particles. Number of the domain having an average area of the Voronoi polygon of 50,000 nm or less is preferably 30% by number and more preferably 60% by number among domain numbers in a toner particles.

The average area of the Voronoi polygon formed by the perpendicular bisecting line between the centers of gravity of the domains, which are adjacent to each other in the toner particle of the present invention, is in the range of 20,000 to 120,000 $nm^2$. When the average is beyond said range, the domain occupying state in the toner particle becomes unacceptable. For example, said fact indicates that colorants which exist as an domain in the particle is not effectively incorporated into the toner particle. As a result, it is not preferable because it is difficult to discern the effects of the present invention.

The variation coefficient of the average area of the Voronoi polygon formed by domains which are adjacent to each other, as described herein, specifies the fluctuation of the area of the Voronoi polygon, namely it specifies the fluctuation of the domain portion occupying state in the toner particle. The variation coefficient of the average area of the Voronoi polygon is commonly in the range of no more than 25 percent, and is preferably in the range of no more than 20 percent. Incidentally, it is not required that the variation coefficient be 0 percent, namely, the state in which the average area of the Voronoi polygon results in no fluctuation, or in other words, any toner particle being in the same domain occupying state.

In the present invention, it is not preferable that the variation coefficient of the average area of the Voronoi polygon exceeds 25 percent, because the fluctuation among the areas of the resulting Voronoi polygons becomes excessively large, making it extremely difficult to discern the effects of the present invention during image formation.

Still further, in the present invention, there are 3 to 20 domains having an area of Voronoi polygons of at least 160,000 $nm^2$ in one toner particle. Said fact implies that those domains are suitably scattered so that each domain is suitably positioned so as to maintain the desired distance. This also means that said domains are not locally positioned and colorants are effectively incorporated into the toner particle.

Further, in the present invention, it is characterized that the non-domain portion of the Voronoi polygon formed by the domain, which is located within the specified range from the center of gravity of the toner particle, is smaller than that of the Voronoi polygon which is formed by the domain beyond said range. Namely, in the present invention, the average area of the Voronoi polygon formed by an domain, which is located beyond the radius 1,000 nm circle having its center at the center of gravity of the toner particle, is greater than that of the area of the Voronoi polygon formed by an domain which is located in said 1,000 nm radius circle. This fact implies that in the toner particle, domains are sparsely scattered in the area somewhat further from the center of gravity of the toner particle. By satisfying said conditions, in the toner of the present invention, the domains are suitably scattered in the toner particle so that the effects, which are obtained by achieving the present invention, are evident.

Further, in the toner of the present invention, the toner particle is comprised of a domain-matrix structures, but has regions, in which no domains are located, in the region along the outer circumference. In the schematic views in FIGS. Toner Particle (a) and Toner Particle (b), the region, which is shown by the length of "a" and the depth of "b" along the outer circumference of the cross-section of the toner particle, comprises no domains. Namely, in the toner of the present invention, it is confirmed that in the region along the outer circumference of the cross-section of the toner particle, said toner comprises regions which do not comprise an domain portion having a depth of 100 to 200 nm, more preferably 120 to 180 nm and a length of 500 to 6,000 nm, more preferably 800 to 4,000 nm.

In the present invention, it is assumed that the absence of domains in the specified regions along the outer circumference of the toner particle specifically contributes to effectively minimizing dislodging of domains from the toner particle. Further, it is also assumed that said absence of domains functions to suitably disperse crystalline materials as well as colorants into the interior of the particle, and to effectively bleed said crystalline materials out during pressure fixing.

Colorant employed in the invention is added in toner particles in a form of finely dispersed liquid having a weight average particle diameter of 30 to 500 nm.

In the invention, the amount of the crystalline substance contained in the toner particle can be measured by extracting the crystalline substance from the toner particle and measuring the spectral transmission of the extract containing the extracted substance. The procedure for releasing the crystalline substance to obtain the extract is described below. In the followings, the crystalline substance extracted from the toner, the extract liquid containing extracted crystalline substance, and the amount of the extracted crystalline substance measured by the spectral transmission are each referred to as the extracted crystalline substance, the extraction liquid and the extracted crystalline substance amount, respectively.

Procedure for Measuring the Extracted Crystalline Substance Amount

The extracted crystalline substance amount is represented by the absorbance or turbidity of a supernatant liquid which is obtained by centrifuging a suspension which is prepared by dispersing the toner particles in a liquid according to the following procedure. In concrete, the supernatant is prepared in the manner described in (1) to (4), and the absorbance of the supernatant is measured by a spectrophotometer using light with wavelength of 500 nm from a lump.

(1) Preparation of a surfactant solution

Into a measuring flask of 100 ml, 90 ml of ion-changed water is put and 1 ml of an aqueous solution containing 12 parts by weight of sodium dodecylbenzenesulfonate is added. Then ion-changed water is gradually added to make the volume of the solution to 100 ml. Thus a surfactant solution is prepared.

(2) Suspension of the toner

Into a glass bottle of 50 ml with a screw stopper, 15 g of the toner is put and 30 ml of the surfactant solution prepared in the above (1) is gradually poured into the bottle. The bottle is closed by the stopper and shaken for 1 minute to prepare a suspension of the toner.

(3) Centrifugation

The toner suspension prepared in the above (2) is put into a centrifugal precipitation tube of 50 ml. The tube is set on an angle rotor with a rotating radius of 70 mm, and subjected to centrifugation at 5,000 rpm for 20 minutes.

(4) Separation of supernatant liquid

Particles of low molecular weight crystalline substance adhered to the inner wall of centrifugal tube by the centrifugation are washed off by the supernatant using a pipette and the supernatant is sampled.

If the precipitated toner particles are mixed into the supernatant, the sample tube is stood to re-precipitate the toner particles or the supernatant is subjected again to the centrifugation to remove the toner particles.

The light absorbance of thus obtained supernatant is measured by a spectral photometer and the amount of the crystalline substance contained in the toner particle is determined according to the spectral absorbance. In the invention, the extracted crystalline substance amount contained in the toner particle is from 70 to 99.5%, preferably from 84 to 99% in terms of spectral transmittance.

The toner particle of the invention having the domain-matrix structure may contain a domain of colorant additionally the domain of the crystalline substance. The domain of the colorant is shown as domain B in FIG. 1(*a*). The domain of the colorant can be easily distinguished from the domain of the crystalline substance on the electron-microscopic photograph according to the difference between the luminance of each of the particles. The various parameters mentioned above are used for specifying the domain of the crystalline substance, not for the colorant domain.

The toner employed in the invention is detailed.

The toner having a variation coefficient of the toner shape coefficient of not more than 16 percent, as well as having a number variation coefficient in the is preferably employed because high image quality, which is exhibited by excellent cleaning properties, as well as excellent fine line reproduction, can be obtained over an extended period of time.

The inventor has found that a corner part of the toner particle becomes round during long time usage in the developing apparatus and the rounded part accelerates the additives embedded in the toner particle, whereby charging amount varies, and fluidity and cleaning ability are reduced.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. And it is possible to obtain high image quality over an extended time of period, which exhibits excellent cleaning properties, as well as excellent fine line reproduction.

The number particle size distribution as well as the number variation coefficient of the toner of the present invention are measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle diameter. The number particle size distribution as described herein represents the relative frequency of toner particles with respect to the toner diameter, and the number average particle diameter represents the median diameter in the number particle size distribution, that is Dn50.

The number variation coefficient in the number particle size distribution of toner is calculated by the formula described below:

$$\text{Number variation coefficient}=(S/Dn)\times 100 \text{ (in percent)}$$

wherein S represents the standard deviation in the number particle size distribution, and $D_n$ represents the number average particle diameter (in $\mu$m), The number variation coefficient of the toner of the present invention is generally not more than 27 percent, and is preferably not more than 25 percent. By controlling the number variation coefficient to be below 27 percent, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

The shape coefficient of the toner particles will be detailed. It is preferable the ratio of toner particles having a shape coefficient of 1.2 to 1.6 is 65 percent by number and variation coefficient of said shape coefficient is 16 percent. The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

Figure 7:
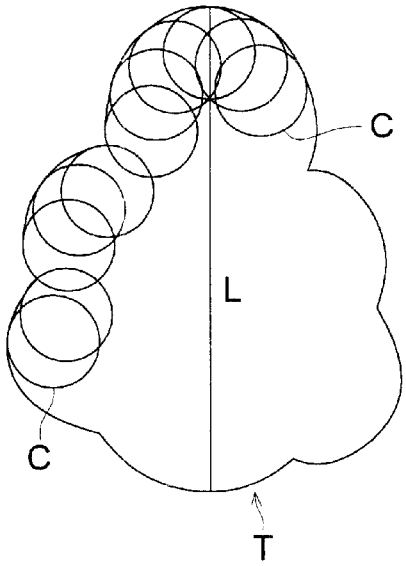
FIG. 7 is a schematic view explaining a toner having either corners or no corners.
Figure 7:
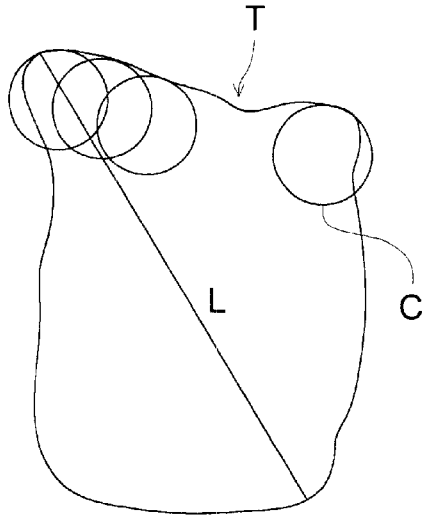
Figure 7:
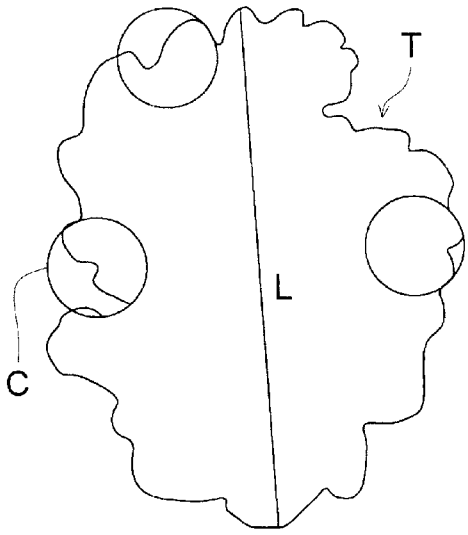
Figure 8:
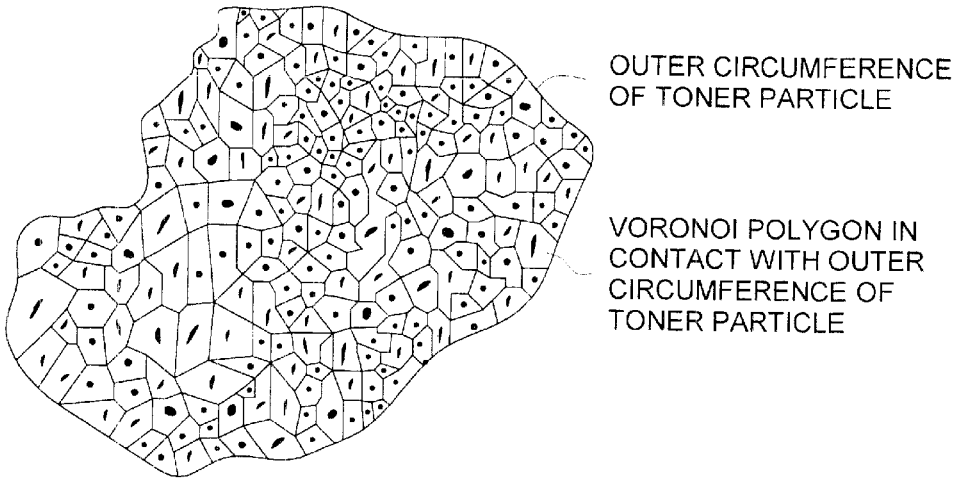
FIG. 8 is a schematic view of the toner particle comprised of a domain-matrix structure of the present invention, which is divided by Voronoi polygons.

The toner particles of the present invention, which substantially have no corners, as described herein, mean those having no projection to which charges are concentrated or which tend to be worn down by stress. Namely, as shown in FIG. 7(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 7(*b*) and 7(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Thus, since the charge amount distribution is narrowed, it is possible to stabilize chargeability, resulting in excellent image quality over an extended period of time.

The toner having no corners can be obtained by various methods. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm 1nD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

(1) Aperture: 100 $\mu$m (2) Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

Number of fine toner particles having strong adhesion which fly to heating device and generate off-set is reduced, and high transfer performance is obtained whereby image quality of half tone, fine line, dot and so on is improved by employing the toner having average diameter of 3 to 9 $\mu$m, preferably 4.5 to 8.5 $\mu$m and more preferably 5 to 8 $\mu$m. Particle diameter is controlled by adjusting concentration of coagulant (salting agent), amount of organic solvent, fusing time, composition of polymer during the toner preparation.

The transfer efficiency is improved, half-tone image quality, and fine line or dot image quality is improved by employing the toner having number average diameter of 3 to 9 $\mu$m. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

Preparation of toner is described.

The resin particles of the toner can be produced by preparing resin particles by polymerization of polymeric monomer in an aqueous medium. The methods include a process preparing particles by a suspension polymerization method, or an emulsion polymerization method or a mini-emulsion polymerization method and then salting out/coagulating.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization and Mini-emulsion Polymerization

The toner according to the invention can be also obtained by salting-off/coagulating resin particles prepared by the emulsion polymerization or the mini-emulsion polymerization.

For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The toner particles are prepared by a process of salting/coagulation of fine particles obtained by polymerization and a colorant. A crystalline material is incorporated in polymerizable monomer liquid in a melted or dissolved state during at least a part of the polymerization process.

The toner according to the invention can be also obtained by salting-off/coagulating resin particles prepared by the emulsion polymerization or the mini-emulsion polymerization.

The production process comprises, for example, the following processes:

1. A multi-step polymerizing process
2. A salting-out/coagulation process to produce a toner particle by salting-out/coagulating the compound resin particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

(Multi-step Polymerization Process)

The multi-step polymerization process is a process for preparing the composite resin particle having broader molecular weight distribution so as to obtain enhanced anti-off-set characteristics. A plural of polymerization reaction is conducted in separate steps so that each particle has different layers having different molecular weight. The obtained particle has a gradient of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-step Polymerization Method)

The two-step polymerization method is a method for producing the composite resin particle comprised of the central portion (core) containing the crystalline material comprising the high molecular weight resin and an outer layer (shell) comprising the low molecular weight resin.

In concrete, a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers.

The diameter of dispersed particles is 10 to 1,000 nm, and is preferably 30 to 300 nm. Phase structure of crystalline material in a toner particle, namely the FERE diameter, the shape coefficient and variation coefficient thereof, may be controlled by broadening the distribution of dispersion particle diameter.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer "ELS-800" (produced by Ohtsuka Denshi Co.).

Glass transition temperature (Tg) of the composite resin particles is preferably from 48 to 74° C., and more preferably from 52 to 64° C. The Softening point of the composite resin particles is preferably from 95 to 140° C.

<Salting-out/Fusion Process>

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

(Ripening Process)

The ripening process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The FERE diameter, the shape coefficient and variation coefficient thereof, may be controlled in this process.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Herein, surface active agents incorporated in a water based medium, which disperse coloring agent particles, are dissolved at a concentration higher than or equal to the critical micelle concentration (CMC). Employed as surface active agents may be those which are exemplified as surface active agents employed in the aforesaid polymerization process.

The weight average particle diameter (being the dispersed particle diameter) of fine coloring agent particles is commonly from 30 to 10,000 nm, is preferably from 30 to 500 nm, and is more preferably from 50 to 300 nm. Incidentally, said weight average particle diameter is determined employing an electrophoretic light scattering photometer "ELS-800" (manufactured by Ohtsuka Denshi Co.).

Fine coloring agent particles employed in the toner of the present invention are prepared as follows. After a coloring agent is charged into a water based medium comprising surface active agents, preliminary dispersion (coarse dispersion) is initially carried out employing a propeller stirrer to prepare a preliminary dispersion in which coagulated particles of said coloring agent are dispersed. The resultant preliminary dispersion is supplied to a stirring apparatus provided with a screen to compartmentalize the stirring chamber and a rotor rotated at a high speed in said stirring chamber and is subjected to a dispersion treatment (being a fine dispersion treatment), employing said stirring apparatus, whereby a dispersion comprised of fine coloring agent particles in a preferred dispersion state is prepared.

Listed as said stirring device for a dispersion treatment to prepare fine coloring agent particles in a preferred dispersion state may be "CLEARMIX", manufactured by M Tech Co., Ltd. Said "CLEARMIX" comprises a rotor (a stirring blade), and a fixed screen (a fixed ring) surrounding said rotor, and has a structure which applies a shearing force, an impact force, pressure variation, cavitation, and a potential core to the treated composition. Said treated composition is effectively emulsify-dispersed utilizing synergistic functions generated by these actions.

Namely, said "CLEARMIX" is originally used to prepare an emulsion (being a dispersion of fine liquid droplets). However, the inventors of the present invention discovered that a fine coloring agent particles dispersion, having a preferred average particles diameter as well as a markedly narrow size distribution, was prepared employing said "CLEARMIX" as an apparatus to disperse fine coloring agent particles into a water based medium.

FIG. 9(*a*) is a schematic view showing a high speed rotating rotor and a fixed screen surrounding said rotor. In FIG. 9(*a*), numeral 101 is a screen and M is a compartmentalized stirring chamber, while 102 is a high speed rotating rotor in stirring chamber M.

Rotor 102 is a high speed rotating stirring blade. Its frequency of rotation is commonly from 4,500 to 22,000 rpm, and is preferably from 10,000 to 21,500 rpm. The peripheral speed of the tip of rotor 102 is commonly from 10 to 40 m/second, and is preferably from 15 to 30 m/second.

Screen 101 provided around rotor 102 is comprised of a fixed ring constituted of many slits (not shown). The slit width is commonly from 0.5 to 5 mm, and is preferably from 0.8 to 2 mm. Further, the number of slits is commonly from 10 to 50, and is preferably from 15 to 30. The clearance between rotor 102 and screen 101 is commonly from 0.1 to 1.5 mm, and is preferably from 0.2 to 1.0 mm.

The average diameter of fine coloring agent particle as well as the particle size distribution is adjusted by controlling the frequency of rotation of rotor 102, and further, may be adjusted by selecting the shape of screen 101 as well as rotor 102. Specifically, the preferred dispersion state is obtained by combinations of screen (S1. 0–24, S1. 5–24, S1. 5–18, S2. 0–18, and S3. 0–9) and said rotor (R1 through R4). However, a further preferred state may be obtained utilizing a unit prepared by an operator.

FIG. 9(*b*) is a schematic view showing a continuous type processing apparatus (CLEARMIX) provided with said rotor as well as said screen. A preliminary dispersed dispersion (being a preliminary dispersion) is supplied from preliminary dispersion inlet 104, shown in FIG. 9(*b*), to a stirring chamber between screen 101 and said rotor. Screen 101 as well as said rotor is surrounded by pressurized vacuum attachment 103, and thermal sensor 106, cooling jacket 107, and cooling coil 108 are arranged. Coloring agent coagulant particles in said preliminary dispersion are provided with a shearing force generated by said high speed rotating rotor and screen 101, and thereby pulverized (finely dispersed).

Namely, coloring agent coagulated particles in the preliminary dispersion, supplied into the belt-shaped stirring chamber provided between screen 101 and said rotor, is subjected to a shearing force (mechanical energy) generated by said screen 101, and the high speed rotation of said rotor, and in addition, a collision force, pressure variation, cavitation, and the action of the potential core, so as to be pulverized (finely dispersed), whereby fine coloring agent particles are formed. The dispersion comprising said fine coloring agent particles is spouted into pressurized vacuum attachment 103 through the slits of screen 101. As a result, obtained is a dispersion comprising fine coloring agent particles, having a preferred average particle diameter as well as a narrow particle size distribution. Said dispersion, comprising fine coloring agent particles, is conveyed from dispersion outlet 105 to the next process.

Said coloring agent coagulated particles are pulverized by the action of said rotor and screen in the stirring apparatus so as to form fine coloring agent particles (dispersed particles) having a preferred average particle diameter as well as a narrow particle size distribution. The formation mechanism of said fine coloring agent particles will be explained based on a plurality of actions described below.

(1) Since in a portion near the surface of a high speed rotating rotor (being a stirring blade), the speed gradient is large, a high speed shearing region is formed at the portion near said surface. As a result, said coloring agent coagulated particles are pulverized by the shearing force generated in said region.

(2) At the rear of said rotor (being a stirring blade), when said rotor rotates at a high speed, a vacuum region is generated. Air bubbles generated by the rotation are eliminated at the stage where the flow rate of the dispersion decreases. At the same time, along with the compression of said air bubbles, impact pressure is generated. Said coloring agent coagulated particles are pulverized by the resulting impact pressure.

(3) When said rotor (being a stirring blade) is rotated at a high speed, said preliminary dispersion is provided with pressure energy. When the resulting pressure energy is rapidly released, the motion energy of said preliminary dispersion is increased. When said preliminary dispersion, which is scattered by said rotor, repeatedly passes between the releasing section (slit section) and the tightly closed section (non-slit section), the resulting pressure energy varies. As a result, pressure waves are generated, thereby pulverizing said coloring agent coagulated particles.

(4) When said preliminary dispersion, having a large motion energy, collide with said screen or other walls, said coloring agent coagulated particles, which are subjected to the resulting collision force, are pulverized, whereby fine coloring agent particles are prepared which have a narrow range of particle size distribution.

(5) When a dispersion having a high velocity energy passes through the slit sections of said screen, a jet flow is formed. In the potential core (a velocity region which is not affected by the action of a viscous flow), the surrounding flow is sucked in at a high speed. The coloring agent coagulated particles, which are subjected to the resulting energy, are pulverized, whereby fine coloring agent particles, having a narrow range of particle size distribution, are prepared.

The time to prepare a fine coloring agent dispersion is commonly from 5 to 80 minutes, and is preferably from 7 to 65 minutes. Further, when circulated, at least 5 passes are preferred, and 5 to 20 passes are more preferred. It is not preferable that said dispersion time be excessively long because dispersion is excessively carried out and the existing amount of fine particles becomes greater than desired.

In order to prepare preferably usable fine coloring agent particles, a batch type dispersing process may be carried out in which a dispersion vessel provided with a stirring apparatus, comprised of said screen and said rotor, is employed, and a coloring agent (being a water based medium comprising a coloring agent) is spouted into the water based medium housed in said dispersion vessel from the stirring chamber of said stirring apparatus.

FIG. 9(*c*) is a schematic view of a dispersion vessel provided with said stirring apparatus (CLEARMIX), and the dispersion process is carried out employing said apparatus. In FIG. 9(*c*), numeral 111 is a dispersion vessel, 112 is a stirring apparatus, and 113 is a stirring shaft to drive said stirring apparatus 112. Said stirring apparatus 112 has the same constitution (said screen and said rotor) shown in FIG. 9(*a*).

Said preliminary dispersion (being a coloring agent coagulated particle dispersion) is introduced into said stirring chamber from the upper section of stirring apparatus 112 and is stirred utilizing a strong shearing force generated between said high speed rotating rotor and said screen, an impact force, and a turbulent flow, whereby fine coloring agent particles, having a weight average particle diameter of 30 to 300 nm, are formed, which are then spouted into dispersing vessel 111 from the slits of said screen. In said dispersion process of fine coloring agent particles, dispersion vessel 111 is subjected to a jacket structure and the temperature of the interior of dispersion vessel 111 may be controlled by flowing heated water, steam, and if desired, by flowing cold water.

When said dispersion process is carried out employing the dispersion vessel shown in FIG. 9(*c*), the spouting direction (the spouting direction of fine coloring agent particles into the water based medium) is preferably in a downward or horizontal direction. By spouting the coloring agent (being fine coloring agent particles) in the downward or horizontal direction, the water based medium flows as shown by arrow F. As a result, said coloring agent is spouted downward, and the resulting flow rises along the wall and is circulated to CLEARMIX. Due to that, it is possible to assuredly repeat said dispersion process, and it is also possible to uniformly provide dispersion energy to said coloring agent. As a result, it is assumed that it is possible to render the dispersed coloring agent particle diameter uniform. As described above, it is possible to effectively form fine coloring agent particles having a narrow range of particle size distribution.

As described above, coloring agent particles preferably employed in the present invention are prepared by pulverizing coloring agent coagulated particles, utilizing the action of a shearing force generated by said screen and said rotor. As a result, a dispersion is prepared which is comprised of fine coloring agent particles (fine particles near primary particles) having a suitable average particle diameter (a weight average particle diameter commonly is 30 to 10,000 nm, is preferably 30 to 500 nm, and is more preferably 50 to 300 nm) as well as a narrow range of particle size distribution (having a standard deviation, σ of less than or equal to 30). Such fine coloring agent particles (dispersion particles) are subjected to salting-out/fusion with fine resinous particles. As a result, said fine coloring agent particles are assuredly introduced into the interior of the resulting toner particle. Introduced coloring agent particles are not dislodged so that no fluctuation occurs with regard to the content ratio of said coloring agent in each of said toner particle.

As a result, when images are formed, employing the resulting toner which has been stored at high temperature and high humidity, or employing an image forming apparatus which has not been operated over an extended period of time, image problems, such as fogging due to the variation of charge amount and minute dots of dust do not occur. Further, in the present invention, since fine coloring agent particles are dispersed in the toner particle without using any media, image problems due to minute residual impurities such as crushed pieces of media in said toner do not occur.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, "CLEARMIX", ultrasonic, homogenizers, mechanical homogenizers, and Manton-Gaulin homogenizers, pressure type homogenizers and medium dispersion machines such as GETSMAN MILL and DIAMOND FINE MILL.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Further, in the present invention, after preparing colored particles (in the present invention, called toner particles) upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Karfft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of minimizing excessive static charge to toner particles and providing uniform static-charge buildup to said toner particles, particularly in order to stabilize static-charge buildup against ambience, as well as to maintain the resulting static-charge buildup, the electrostatic image developing toner of the present invention preferably comprises the aforesaid metal elements (listed as such forms are metals and metal ions) in an amount of 250 to 20,000 ppm in said toner and more preferably in an amount of 800 to 5,000 ppm.

Further, in the present invention, the total concentration of divalent (or trivalent) metal elements employed in coagulants and univalent metal elements added as coagulation inhibiting agents, described below, is preferably from 350 to 35,000 ppm. It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

(Filtration and Washing Process)

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

(1) Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

Listed as halogenated olefin based monomers are vinyl chloride, vinylidene chloride, vinyl bromide, and the like.

(2) Crosslinking monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer having an acidic polar group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts.

(4) Monomer having a basic polar group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrlamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

(Chain Transfer Agents)

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapt group, a neopentyl glycol compound having mercapt group, and a pentaerythritol compound having mercapt group. Among them n-octyl-3-mercaptopropionic acid ester is preferable in view of minimizing smell at the time of thermal fixing.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$$R^1(OR^2)_nOSO_4M \qquad \text{General Formula (1)}$$

$$R^1(OR^2)_nSO_3M \qquad \text{General Formula (2)}$$

In General Formulas (1) and (2), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl group, a diphenylmethyl group, a cinnamyl group, a styryl group, a trityl group, and a phenethyl group.

In General Formulas (1) and (2), $R^2$ represents an alkylene group having from 2 to 6 carbon atoms. $R^2$ is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (1) and (2), n represents an integer of 1 to 11; and n is preferably from 2 to 10, is more preferably from 2 to 5, and is most preferably 2 or 3.

In General Formulas (1) and (2), listed as univalent metal elements represented by M are sodium, potassium, and lithium. Of these, sodium is preferably employed.

Specific examples of surface active agents represented by General Formulas (1) and (2) are illustrated below:

Compound (101): $C_{10}H_{21}(OCH_2CH_2)_2OSO_3Na$

Compound (102): $C_{10}H_{21}(OCH_2CH_2)_3OSO_3Na$

Compound (103): $C_{10}H_{21}(OCH_2CH_2)_2OS_3Na$

Compound (104): $C_{10}H_{21}(OCH_2CH_2)_3OSO_3Na$

Compound (105): $C_8H_{17}(OCH_2CH(CH_3))\ 2OSO_3Na$

Compound (106): $C_{18}H_{37}(OCH_2CH_2)_2OSO_3Na$

In the present invention, from the viewpoint of maintaining the electrostatic charge holding function of toner in the desired state, minimizing fogging at high temperature and high humidity, and improving transferability, as well as minimizing an increase in electrostatic charge at low temperature and low humidity, and stabilizing the development amount, the content of the surface active agents represented by the aforesaid General Formulas (1) and (2) in the electrostatic image developing toner is preferably from 1 to 1,000 ppm, is more preferably from 5 to 500 ppm, and is most preferably from 7 to 100 ppm.

In the present invention, by adjusting the amount of the surface active agents incorporated to said range, the static charge of the electrostatic image developing toner of the present invention is built up being independent of ambience, and can be uniformly and stably provided and maintained.

Further, the content of the surface active agents represented by the aforesaid General Formulas (1) and (2) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMR, and the structure of the surface active agents represented by General Formulas (1) and (2) is determined.

Metal salts may be employed preferably as coagulants when resin particles are salting-out, coagulating and fusing procedure from dispersion of the resin particles prepared in water based medium. Divalent or trivalent metal salts are preferably employed as the coagulation agent particularly. The divalent or trivalent metal salts are better than monovalent metal salts since they have small critical coagulation concentration.

Nonion surface active agents may also be employed in the invention. Practical examples include polyethyleneoxide, polypropyleneoxide, a combination of polyethyleneoxide and polypropyleneoxide, ester of polyethyleneglycol with higher fatty acid, alkylphenolpolyethyleneoxide, ester of polypropyleneoxide with higher fatty acid, sorbitan ester.

The surface active agent is employed mainly as an emulsifier, and may be used for other purpose in the other process.

(Molecular Weight Distribution of Resin Particles and Toner)

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G500OH, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed in the processes of salting-out, coagulation and fusion from the dispersion of resin particles prepared in t e aqueous medium. The two or three valent metal salt is preferable to monovalent metal salt because of low critical coagulation concentration (coagulation point).

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

<Colorants>

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these.

Further, the added amount of said pigments is commonly between 2 and 20 percent by weight with respect to the polymer, and is preferably between 3 and 15 percent by weight.

Employed as said organic pigments and dyes may be those conventionally known in the art. Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

(Crystalline Materials)

Toner employed in the invention is preferably prepared by fusing resin particles containing a crystalline material and colored particles in water based medium and then digesting the obtained particles whereby the crystalline material and the colorant are dispersed in resin matrix adequately to form a domain-matrix structure. The ripening is a process subjecting the fused particles to continuing agitation at a temperature of melting point of the crystalline material plus minus 20 centigrade.

Preferable examples of the crystalline material having releasing property include low molecular weight polypropylene having average molecular weight of 1,500 to 9,000 and low molecular weight polyethylene, and a particularly preferable example is an ester compounds represented by General Formula (1), described below.

$$R^1—(OCO—R^2)_n \quad (1)$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3—(CH_2)_{12}—COO—(CH_2)_{17}—CH_3$
2) $CH_3—(CH_2)_{18}—COO—(CH_2)_{17}—CH_3$
3) $CH_3—(CH_2)_{20}—COO—(CH_2)_{21}—CH_3$
4) $CH_3—(CH_2)_{14}—COO—(CH_2)_{19}—CH_3$
5) $CH_3—(CH_2)_{20}—COO—(CH_2)_6—O—CO—(CH_2)_{20}—CH_3$

6)

$$CH_3—(CH_2)_{20}—COO—(CH_2)_2—\underset{}{\overset{CH_3}{\overset{|}{C}}}H—CH_2—O—CO—(CH_2)_{20}—CH_3$$

7)

$$CH_3—(CH_2)_{22}—COO—(CH_2)_2—\overset{CH_3}{\overset{|}{C}}H—CH_2—O—CO—(CH_2)_{22}—CH_3$$

8)

$$CH_3—(CH_2)_{22}—COO—CH_2—\underset{CH_3}{\underset{|}{\overset{CH_3}{\overset{|}{C}}}}—CH_2—O—CO—(CH_2)_{22}—CH_3$$

9)

$$CH_3—(CH_2)_{26}—COO—CH_2—\underset{CH_3}{\underset{|}{\overset{CH_3}{\overset{|}{C}}}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

-continued

11)

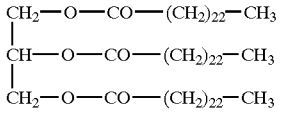

12)

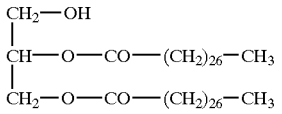

13)

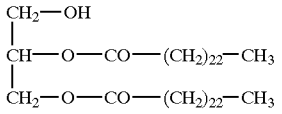

14)

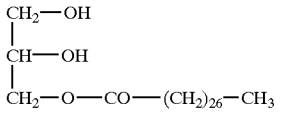

15)

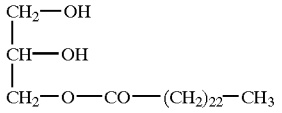

16)

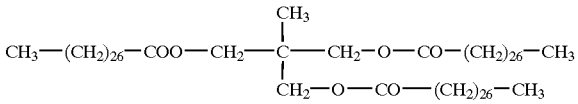

17)

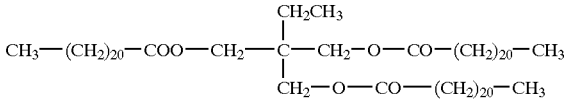

18)

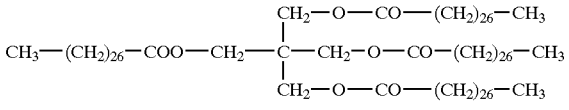

19)

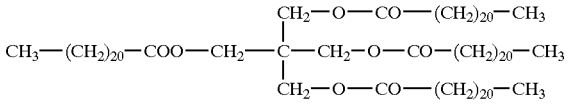

20)

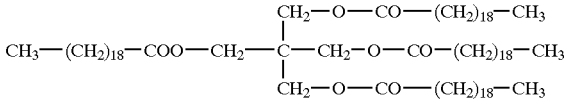

21)

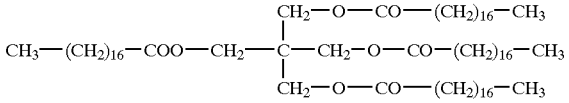

-continued

22)

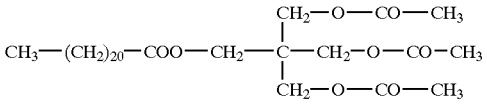

As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconate, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline polyester compound, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The image forming apparatus employed in the image forming method using the toner of the invention is described.

Figure 3:
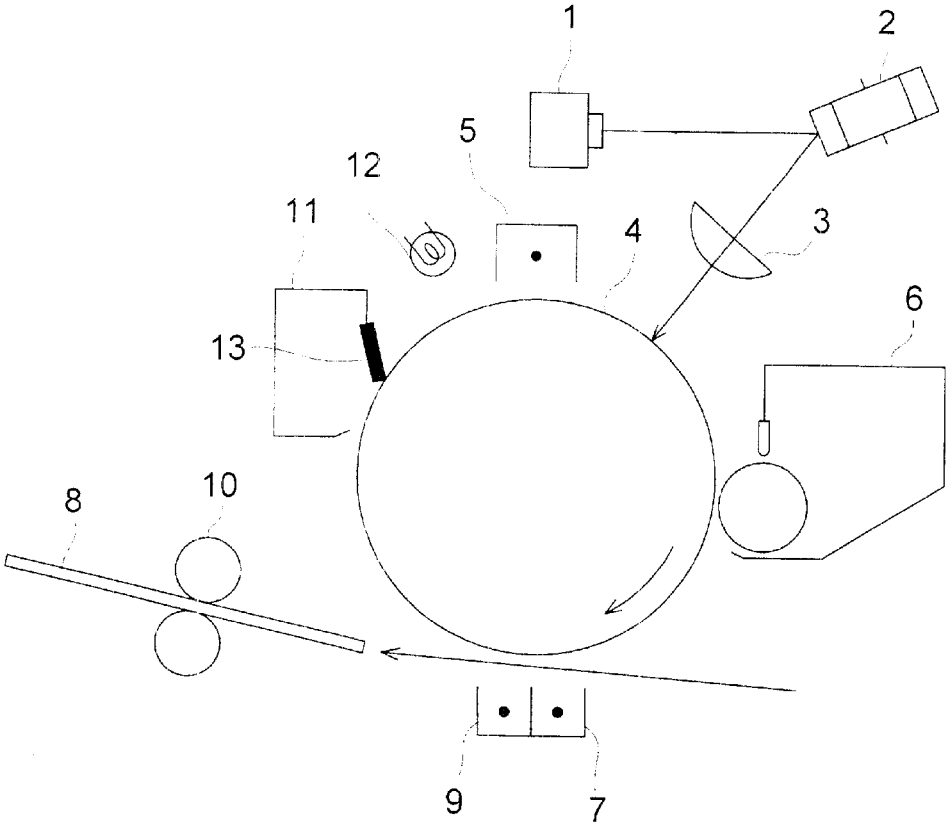
FIG. 3 a cross-sectional view showing one example of the structure of an image forming apparatus applied to the present invention.

A cross-section of a color forming apparatus is shown in FIG. 3 as an example of the color forming apparatus for describing the image forming method according to the invention. In FIG. 3, numeral 4 shows a photoreceptor drum as a latent image carrier, which is constituted by coating OPC or organic photosensitive substance, on a substrate drum. The photoreceptor drum is grounded and driven so as to be clockwise rotated as is shown in the drawing.

Light exposure is emitted from laser diode source 1 according to the image information read in by reading means, not shown in FIG. 3. The light is scanned in a direction perpendicular to the paper plain by a rotating polygon mirror 2, and is exposed to the photoreceptor to form a latent image through an fθ lens 3, which compensate distortion of image. The photoreceptor drum 4 is charged uniformly by a charger 5 previously and starts rotation synchronized with the timing of the image exposure.

The latent image on the photoreceptor is developed by developing device 6, and the developed image is transferred to synchronously driven transferee paper 8 by transfer device 7. The transferee paper 8 is separated from the photoreceptor 4 by separating device (separating pole) 9, and the transferred image on the transferee paper is carried to fixing device to be fixed.

Remaining toner particles on the photoreceptor are swept by cleaning device 11. The residual charge on the photoreceptor is cancelled through precharging exposure light 12, and the photoreceptor is again charged uniformly by charging device 5.

Methods for recycling toner are not particularly limited. For example, it is possible to cite a method in which toner recovered at a cleaning section is conveyed to a hopper for supply toner, or a development unit employing a transport conveyer or a transport screw, or is blended with a supply toner in an intermediate chamber and supplied to a development unit. As preferred methods, it is possible to list methods in which the recovered toner is directly returned to the development unit or the recovered toner is blended with the supply toner and then supplied to the development unit.

Figure 4:
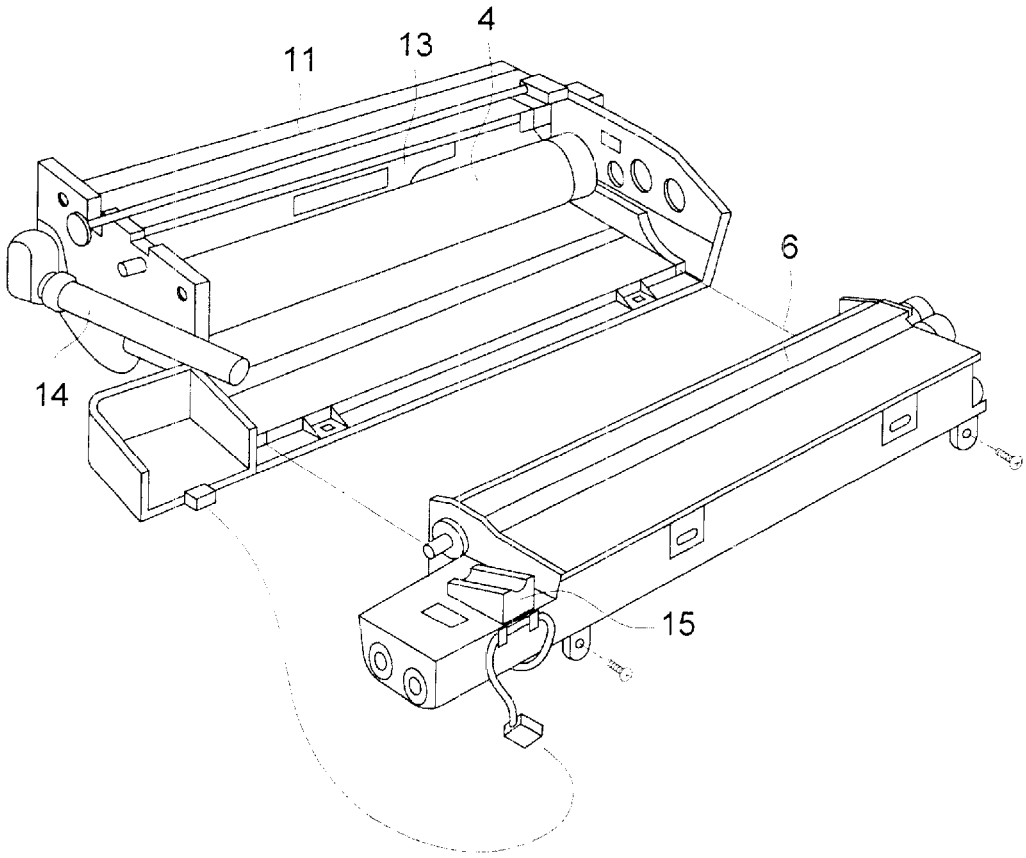
FIG. 4 is a perspective view showing the structure of a toner recycling member.

FIG. 4 is a perspective view of one example of the constitution of a toner recycling member. This method is one in which the recovered toner is returned directly to the development unit.

Non-transferred toner recovered by cleaning blade 13 is collected and fed into toner recycling pipe 14, employing a transport screw in toner cleaning unit 11; then returned to development unit 6 from inlet 15 of said recycling pipe; and again employed as developer.

FIG. 4 is also a perspective view of a detachable processing unit which is secured to the image forming apparatus of the present invention. In said FIG. 4, in order to clarify the perspective configuration, the photoreceptor unit is drawn separately from the developer unit. However, these may be integrated and detachably attached as a unit to the image forming apparatus. In this case, the photoreceptor, the development unit, the cleaning unit and the recycling member are integrated and comprised as the processing cartridge.

Further, said image forming apparatus may be structured so that a processing cartridge can be installed which comprises at least one of a photoreceptor drum, a charging unit, a development unit, a cleaning unit, or a recycling member.

Representative transfer paper includes plain paper. However, it is not particularly limited as long as unfixed images after development can be transferred, and includes a PET base for OHP.

Further, cleaning blade 13 is comprised of an elastic rubber body having a thickness of 1 to 30 mm. As such material, urethane rubber is most frequently employed. Since cleaning blade 13 is employed by being brought into pressure contact with the photoreceptor, it easily transmits heat. As a result, it is preferable to be withdrawn from the photoreceptor by providing a releasing mechanism while the image forming operation is not being performed.

Figure 5:
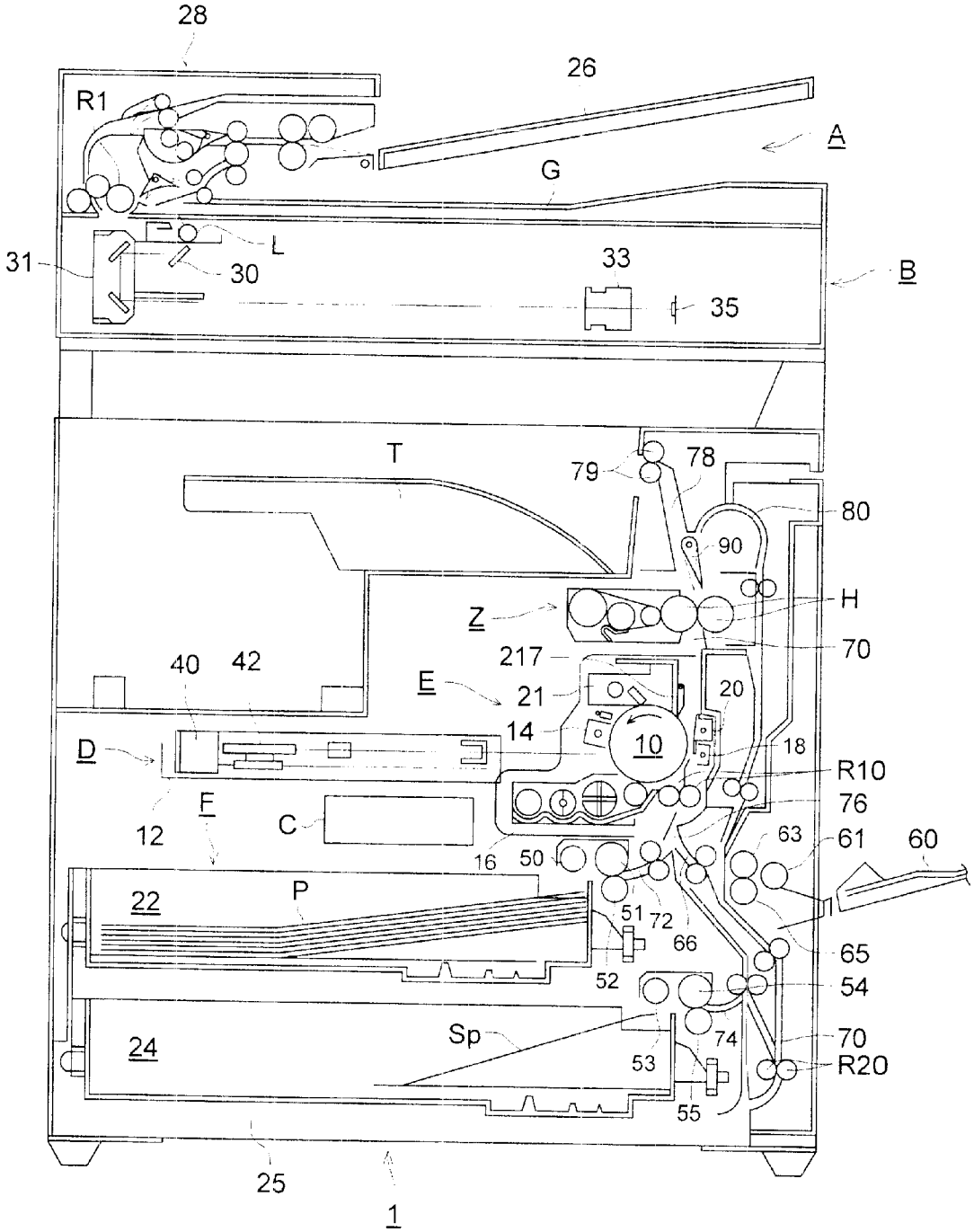
FIG. 5 is a schematic view showing a digital image forming apparatus applied to the present invention.

It is possible to apply the present invention to an apparatus utilizing the electrophotographic method, especially an apparatus in which electrostatic images are formed on the photoreceptor, utilizing a modulation beam which has been modulated based on digital image data from a computer. FIG. 5 is a schematic view showing a digital image forming apparatus which is applied to the toner of the present invention.

In recent years, in the electrophotographic field wherein electrostatic latent images are formed on a photoreceptor and the resultant latent images are developed to prepare visible images, increasingly carried out has been research and development of the image forming method utilizing a digital system which makes it possible to easily carry out improvement in image quality, transformation, and edition, and to form high quality images.

As computers which are employed in said image forming method and apparatus thereof, or an optical scanning system which carries out light modulation based on digital image signals from copying original documents, included are a unit in which an acoustic optical modulator is provided via an optical laser system and light modulation is carried out employing said acoustic optical modulator, as well as a unit in which a semiconductor laser is employed and laser intensity is subjected to direct modulation. Spot exposure is carried out onto a uniformly charged photoreceptor from said optical scanning system whereby dot images are formed.

A beam irradiated from said optical scanning system results in a circular or elliptical luminance distribution near the normal distribution having a wide range at both sides. For example, a laser beam in either the primary direction or the secondary direction, or in both directions on the photoreceptor, generally results in extremely narrow circles or ellipses of 20 to 100 $\mu$m.

The toner of the present invention is suitably applied to the image forming method comprising a process in which an image forming support, on which a toner image is formed, is passed between a heating roller and a pressing roller, constituting a fixing unit, so as to fix said image.

Figure 6:
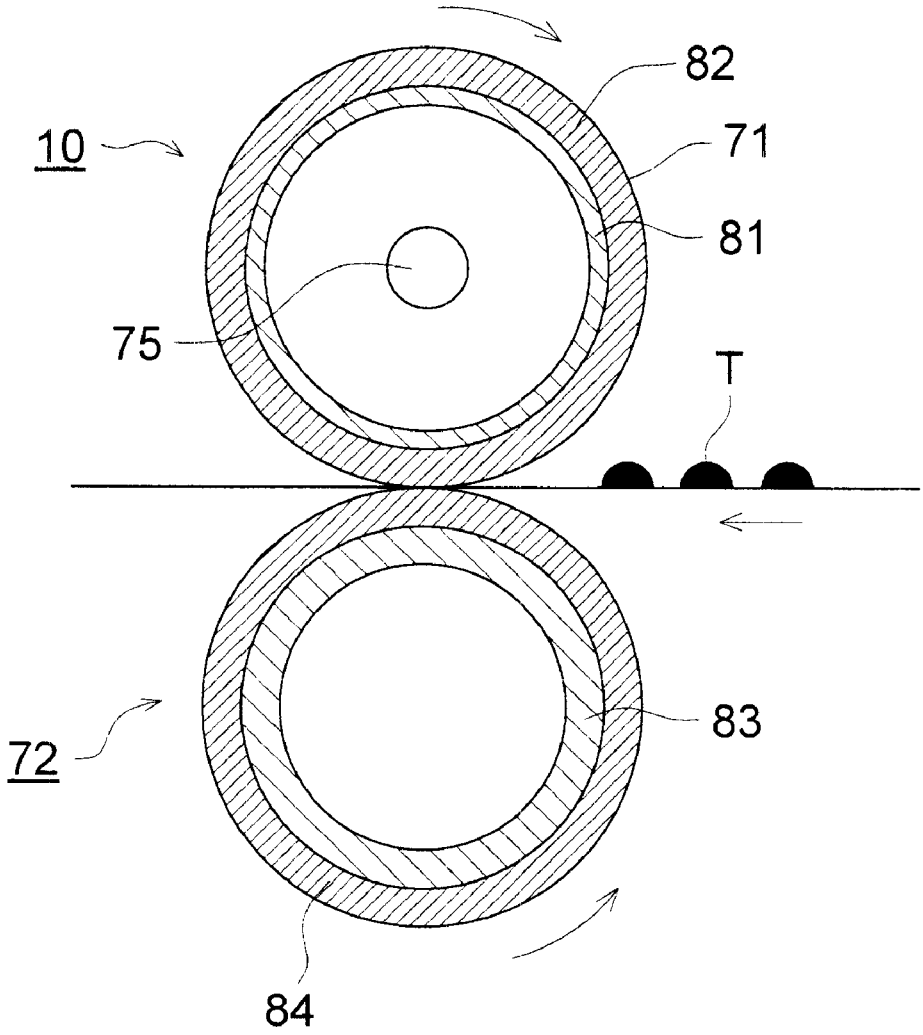
FIG. 6 is a schematic cross-sectional view showing a fixing unit applied to the present invention.

FIG. 6 is a cross-sectional view showing one example of a fixing unit used in an image forming method employing the toner of the present invention. Fixing unit 10, shown in FIG. 6, is comprised of heating roller 71, and pressing roller 72 which comes into contact with said heating roller 71. Incidentally, in FIG. 6, T is a toner image formed on a transfer paper (being the image forming support).

Said heating roller 71 is prepared by forming cover layer 82 comprised of fluorine resins or an elastic body on the surface of metal pipe 81 and includes heating member 75 comprised of a linear heater in its interior.

Metal pipe 81 is comprised of metal, and its interior diameter is from 10 to 70 mm. Metals which comprise metal pipe 81 are not particularly limited, and may include, for example, iron, aluminum, and copper, and alloys thereof.

The wall thickness of said metal pipe 81 is from 0.1 to 15 mm, and is determined taking into account the balance between the energy saving demand (a decrease in the wall thickness) and strength (being dependent on composition of the materials). For example, when the strength exhibited by a metal pipe comprised of iron with a wall thickness of 0.57 mm is intended to obtain employing a metal pipe comprised of aluminum, it is necessary to increase its wall thickness to 0.8 mm.

Exemplified as fluorine resins constituting covering layer 82 may be PTFE (polytetrafluoroethylene), PFA (tertafluoroethylene-perfluoroalkyl vinyl ether copolymers), and the like.

The thickness of covering layer is usually 10 to 500 $\mu$m, and is preferably 20 to 400 $\mu$m.

The elastic material forming a covering layer 82 includes silicone rubber or silicone sponge, which has good heat resistance, such as LTV, RTV and HTV.

An Asker C harness of the elastic material covering layer 82 is less than 80 degrees, preferably less than 80 degrees.

The thickness of the elastic material covering layer 12 is 0.1 to 30 mm, and preferably 0.1 to 20 mm.

Halogen heaters may be suitably employed as heating member 75.

Pressure roller 72 comprises cylinder 83 having on its surface covering layer 84 comprised of elastic materials. Elastic materials constituting covering layer are not particularly limited, and may include various types of soft rubber such as urethane rubber, silicone rubber, and the like, and also foamed rubber. Silicone rubber as well as silicone sponge rubber is preferably employed, which is exemplified as those constituting covering layer.

The Asker C hardness of elastic materials, constituting covering layer 84, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

Materials constituting cylinder 21 include metals such as aluminum, iron, copper, and the like, and alloys thereof.

The contact load (total load) of heating roller 10 applied to pressure roller 72 is usually 40 to 350 N, is preferably 50 to 300 N, and is more preferably 50 to 250 N. Said load is set taking into the strength (the wall thickness of cylinder 81) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 6 is employed, an example of fixing conditions are as follows: fixing temperature (surface temperature of heating roller 10) is 150 to 210° C., and fixing linear speed is 230 to 900 mm/second.

EXAMPLES

The present inventing will now he detailed with reference to examples. The term "part(s)" denotes part (s) by weight.

Preparation of Latex

LATEX 1HML (1) Preparation of Core particle (a first stage polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (101) in 3,010 g of deionized water, and the interior temperature was raised to 80° C. under a nitrogen gas flow while stirring at 230 rpm.

(101) $C_{10}H_{21}(OCH_2CH_2)_2OSO_4Na$

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resin particles) was obtained. The resulting latex was designated as Latex (1H).

(2) Forming an inter layer

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant (101) dissolved in 2,700 ml of deionized water was heated to 90° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resin particles which are composed of resin particles having higher molecular weight polymer resin covered with an intermediate molecular weight polymer) was obtained (a second stage polymerization). The resulting latex was designated as Latex (1HM).

Particles having diameter of 400 to 1,000 nm composed of mainly Exemplified Compound 19), which is not incorporated in the latex particles, are observed in the dried the Latex 1HM by scanning electron microscope.

(3) Forming Outer Layer (Third stage polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third stage polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the latex 1HML have peaks at molecular weight of 138,000, 80,000 and 13,000, and weight average particular size of the composite resin particles was 122 nm.

Latex 2HML

Latex 2HML was prepared in the same manner as the preparation of 1HML except that 7.08 g of anionic surface active agent, sodium dodecylsulfonate (SDS) was employed in place of the surface active agent (101). Latex 2HML is a dispersion of composite resin particle having core part composed of high molecular weight resin, inter layer part composed of middle molecular weight resin and outer layer part composed of low molecular weight resin.

The polymers composed of composite resin particles composing the latex 2HML have peaks at molecular weight of 138,000, 80,000 and 12,000, and weight average particular size of the composite resin particles was 110 nm.

(Preparation of Colored Particles 101 to 116, 201 to 213, Comparative Colored Particles 101 to 105 and Comparative Colored Particles 201 to 204)

Added to 1600 ml of deionized water were 59.0 g of anionic surface active agent (101), which were stirred and dissolved. While stirring the resulting solution, 420.0 g of carbon black, "Regal 330" (produced by Cabot Corp.), were gradually added, and subsequently dispersed employing a stirring unit, "CLEARMIX" (produced by M Technique Ltd.). Colorant Dispersion 1 was obtained. Weight average weight particle diameter of the Black Colorant in the dispersion was 89 nm, measured by employing an electrophoresis light scattering photometer "ELS-800" (produced by Ohtsuka Denshi Co.).

Placed into a four-necked flask fitted with a temperature sensor, a cooling pipe, a nitrogen gas inlet unit, and a stirring unit were 420.7 g (converted in solid content) of Latex (1HML), 900 g of deionized water, and 166 g of Colorant Dispersion 1, and the resulting mixture was stirred. After adjusting the interior temperature to 30° C., 5 N aqueous sodium hydroxide solution was added to the resulting solution, and the pH was adjusted to within the range from 8 to 10.0.

Subsequently, an aqueous solution prepared by dissolving 12.1 g of magnesium chloride tetrahydrate in 1,000 ml of deionized water was added at 30° C. over 10 minutes. After setting the resulting mixture aside for 3 minutes, it was heated so that the temperature was increased to 90° C. within the range from 6 to 60 minutes. While maintaining the resulting state, the diameter of coalesced particles was measured employing a "Coulter Counter TA-II". When the volume average particle diameter reached 4 to 7 μm, the growth of particles was terminated by the addition of an aqueous solution prepared by dissolving 80.4 g of sodium chloride in 1,000 ml of deionized water, and further fusion was continually carried out at a liquid media temperature of 85 to 98° C. for 2 to 12 hours, while being heated and stirred (ripening process).

Thereafter, the temperature was decreased to 30° C. Subsequently, the pH was adjusted to 2.0, and stirring was terminated. The resulting coalesced particles were collected through filtration, and washed with deionized water repeatedly. Washed particles were then dried by air at 40° C., and the colored particles were obtained.

The colored particles 101–116 and comparative colored particles 101–105 having characteristics of dispersion state, shape, particle size distribution and domain-matrix structure respectively shown in Tables 1 and 2, were obtained by controlling the dispersion property, shape and variation coefficient of shape of crystalline material and colorant, by varying pH during coagulation process, temperature, time and agitation strength of ripening process, and further by classification in liquid.

The colored particles 201–213 and comparative colored particles 201–204 having characteristics of dispersion state, shape, particle size distribution and domain-matrix structure respectively shown in Tables 3 to 5, were obtained by controlling the dispersion property, shape and variation coefficient of shape of crystalline material and colorant, by varying pH during coagulation process, temperature, time and agitation strength process, and further by classification in liquid.

TABLE 1

| Colored Particle No. | Number Average Particle size (μm) | Ratio of shape coefficient of 1.2 to 1.6 (%) | Variation coefficient of shape coefficient | Ratio of toner particles having no corner (%) | Variation coefficient of particle size | M (sum of m1 and m2) (%) |
|---|---|---|---|---|---|---|
| 101 | 4.7 | 74.1 | 15.8 | 59 | 23.3 | 70.1 |
| 102 | 5.7 | 70.4 | 15.2 | 47 | 25.0 | 72.4 |
| 103 | 6.6 | 64.4 | 15.4 | 59 | 23.3 | 75.7 |
| 104 | 7.2 | 63.5 | 15.1 | 46 | 24.2 | 54.2 |
| 105 | 7.8 | 67.2 | 16.5 | 55 | 25.6 | 64.5 |
| 106 | 4.7 | 68.1 | 14.8 | 44 | 30.1 | 61.6 |
| 107 | 7.2 | 46.5 | 30.5 | 39 | 32.5 | 51.4 |
| 108 | 4.2 | 74.1 | 14.2 | 59 | 22.7 | 75.5 |
| 109 | 6.2 | 74.1 | 15.4 | 56 | 24.7 | 72.6 |
| 110 | 6.1 | 74.1 | 15.8 | 52 | 23.4 | 72.1 |
| 111 | 6.8 | 74.1 | 15.5 | 60 | 20.1 | 73.5 |
| 112 | 4.0 | 74.1 | 14.4 | 62 | 26.7 | 76.2 |
| 113 | 7.7 | 74.1 | 13.8 | 63 | 26.6 | 71.3 |
| 114 | 6.5 | 74.1 | 14.5 | 58 | 26.0 | 75.5 |
| 115 | 5.6 | 74.1 | 15.4 | 63 | 23.7 | 76.8 |
| 116 | 4.1 | 74.1 | 14.8 | 50 | 19.5 | 72.9 |

TABLE 1-continued

| Colored Particle No. | Number Average Particle size (μm) | Ratio of shape coefficient of 1.2 to 1.6 (%) | Variation coefficient of shape coefficient | Ratio of toner particles having no corner (%) | Variation coefficient of particle size | M (sum of m1 and m2) (%) |
|---|---|---|---|---|---|---|
| Comp. 101 | 5.9 | 74.1 | 15.7 | 62 | 20.1 | 72.6 |
| Comp. 102 | 7.4 | 74.1 | 14.5 | 52 | 25.3 | 71.2 |
| Comp. 103 | 8.0 | 74.1 | 14.9 | 51 | 26.4 | 75.0 |
| Comp. 104 | 6.3 | 74.1 | 15.4 | 53 | 24.6 | 72.1 |
| Comp. 105 | 5.4 | 66.8 | 15.8 | 54 | 26.8 | 70.5 |

TABLE 2

| Colored Particle No. | Average ratio of major axis to minor axis | Number of peaks in Ellipse | Extracted wax (%) |
|---|---|---|---|
| 101 | 1.46 | 0 | 91.0 |
| 102 | 1.61 | 0 | 90.2 |
| 103 | 1.78 | 0 | 91.4 |
| 104 | 1.62 | 0 | 96.2 |
| 105 | 1.43 | 0 | 86.3 |
| 106 | 1.43 | 0 | 84.2 |
| 107 | 1.75 | 0 | 85.1 |
| 108 | 2.03 | 0 | 98.1 |
| 109 | 1.17 | 0 | 93.6 |
| 110 | 1.71 | 2 | 87.3 |
| 111 | 1.50 | 3 | 95.4 |

TABLE 2-continued

| Colored Particle No. | Average ratio of major axis to minor axis | Number of peaks in Ellipse | Extracted wax (%) |
|---|---|---|---|
| 112 | 1.74 | 0 | 72.0 |
| 113 | 1.65 | 0 | 99.3 |
| 114 | 1.67 | 0 | 86.2 |
| 115 | 1.84 | 0 | 87.9 |
| 116 | 1.80 | 0 | 86.7 |
| Comp. 101 | 1.12 | 0 | 72.8 |
| Comp. 102 | 1.82 | 1 | 84.5 |
| Comp. 103 | 1.44 | 2 | 66.0 |
| Comp. 104 | 1.58 | 2 | 99.8 |
| Comp. 105 | 1.18 | 3 | 70.9 |

TABLE 3

| Colored Particle No. | Number Average Particle size (μm) | Ratio of shape coefficient of 1.2 to 1.6 (%) | Variation coefficient of shape coefficient | Ratio of toner particles having no corner (%) | Variation coefficient of particle size | M (sum of m1 and m2) (%) |
|---|---|---|---|---|---|---|
| 201 | 5.9 | 69.7 | 13.0 | 70.4 | 15.2 | 83.6 |
| 202 | 6.9 | 70.8 | 13.9 | 47.0 | 25.4 | 76.3 |
| 203 | 4.7 | 59.1 | 13.8 | 64.9 | 14.7 | 75.8 |
| 204 | 5.8 | 58.1 | 14.3 | 46.0 | 22.7 | 54.2 |
| 205 | 7.8 | 60.6 | 16.5 | 62.3 | 26.7 | 64.5 |
| 206 | 7.6 | 66.7 | 15.8 | 44.0 | 30.1 | 61.6 |
| 207 | 7.9 | 42.8 | 30.5 | 39.0 | 32.5 | 51.4 |
| 208 | 5.7 | 66.6 | 14.7 | 69.2 | 22.2 | 74.0 |
| 209 | 6.6 | 70.2 | 12.5 | 69.9 | 20.8 | 81.6 |
| 210 | 7.8 | 69.5 | 13.0 | 56.5 | 22.7 | 81.8 |
| 211 | 7.1 | 67.4 | 12.4 | 67.6 | 26.8 | 77.1 |
| 212 | 6.3 | 66.9 | 15.3 | 70.2 | 16.0 | 76.6 |
| 213 | 7.5 | 69.7 | 14.2 | 50.8 | 14.8 | 81.4 |
| Comp. 201 | 7.7 | 73.9 | 14.5 | 50.6 | 20.5 | 82.8 |
| Comp. 202 | 7.2 | 67.1 | 15.3 | 69.7 | 22.1 | 80.3 |
| Comp. 203 | 7.7 | 73.7 | 13.1 | 65.9 | 24.3 | 73.2 |
| Comp. 204 | 4.5 | 65.2 | 13.8 | 52.2 | 16.9 | 79.1 |

TABLE 4

| Colored Particle No. | Average of the smallest distance between the walls (nm) | Domains having the smallest distance between the of not less than 1300 nm (%) | Number of domains exposed at the surface of the toner particle | Endothermic peak in DSC curve (° C.) | endotherm quantity (J/g) |
|---|---|---|---|---|---|
| 201 | 396 | 0.7 | 0 | 83.2 | 10.4 |
| 202 | 389 | 2.4 | 0 | 83.4 | 10.2 |
| 203 | 577 | 3.9 | 0 | 83.1 | 11.8 |
| 204 | 281 | 1.4 | 0 | 83.7 | 10.6 |
| 205 | 613 | 2.1 | 0 | 83.4 | 10.7 |
| 206 | 631 | 3.9 | 0 | 83.3 | 10.6 |
| 207 | 795 | 2.3 | 0 | 83.3 | 10.3 |
| 208 | 1044 | 1.9 | 0 | 83.2 | 10.4 |
| 209 | 118 | 2.3 | 0 | 83.4 | 10.5 |
| 210 | 465 | 9.7 | 0 | 83.1 | 10.6 |
| 211 | 660 | 2.8 | 0 | 83.2 | 10.7 |
| 212 | 573 | 3.4 | 0 | 83.5 | 10.9 |
| 213 | 573 | 1.9 | 0 | 83.1 | 10.5 |
| Comp. 202 | 1084 | 2.8 | 3 | None | — |
| Comp. 203 | 84 | 1.1 | 2 | None | — |
| Comp. 204 | 573 | 18.4 | 1 | None | — |
| Comp. 202 | 1098 | 12.4 | 1 | None | — |

TABLE 5

| Colored Particle No. | Average area of Voronoi polygon | Variation coefficient of area of Voronoi polygon | Ratio of toner particles having Voronoi polygon area of 1600 $nm^2$ (%) | Average area of Voronoi polygon inside 1,000 nm radius circle | Average area of Voronoi polygon outside 1,000 nm radius circle | The number of the domain having Voronoi polygon area at least 160,000 $nm^2$ contact with the external circumference |
|---|---|---|---|---|---|---|
| 201 | 84,400 | 16.6 | 12.6 | 81,000 | 88,600 | 4 |
| 202 | 79,200 | 18.0 | 12.7 | 76,000 | 83,100 | 8 |
| 203 | 54,800 | 15.2 | 7.9 | 52,600 | 57,500 | 12 |
| 204 | 40,700 | 16.2 | 16.7 | 39,000 | 42,700 | 4 |
| 205 | 99,700 | 11.7 | 8.7 | 95,700 | 104,600 | 8 |
| 206 | 44,200 | 19.3 | 11.4 | 42,400 | 46,400 | 13 |
| 207 | 49,200 | 13.0 | 15.1 | 47,200 | 51,600 | 11 |
| 208 | 44,500 | 13.4 | 7.5 | 42,700 | 46,700 | 18 |
| 209 | 81,600 | 8.7 | 12.2 | 78,300 | 85,600 | 22 |
| 210 | 77,300 | 17.0 | 7.6 | 74,200 | 81,100 | 9 |
| 211 | 117,500 | 23.9 | 12.6 | 112,800 | 123,300 | 13 |
| 212 | 22,300 | 7.7 | 13.7 | 21,400 | 23,400 | 29 |
| 213 | 57,900 | 14.7 | 2.5 | 97,600 | 92,200 | 2 |
| Comp. 201 | 50,700 | 17.9 | 15.9 | 48,600 | 53,200 | 28 |
| Comp. 202 | 69,400 | 10.4 | 8.1 | 66,600 | 72,800 | 21 |
| Comp. 203 | 57,700 | 15.9 | 12.0 | 55,300 | 60,500 | 11 |
| Comp. 204 | 51,400 | 14.4 | 14.4 | 49,300 | 53,900 | 13 |

Added to each of Colored Particles 1 through 16 and Cooperative Colored Particles 1 through 7 were 0.8 part by weight of hydrophobic silica and 1.0 part by weight of hydrophobic titanium oxide, and the resulting mixture was mixed for 25 minutes while setting the peripheral velocity of the rotation blades of a 10-liter Henschel mixer at 30 m/second. Incidentally, it was confirmed that these colored particles exhibited no variation of shape and particle diameter by the addition of external additives.

Production of Carrier

Production of Ferrite Core Materials

A mixture consisting of 18 mol percent of MnO, 4 mol percent of MgO, and 78 mol percent of $Fe_2O_3$ was crushed for 2 hours, employing a wet ball mill, blended and dried. Thereafter, the resulting mixture was temporarily burned while maintained at 900° C. for 2 hours, and subsequently crushed for 3 hours to form a slurry. Dispersing agents and binders were added, and the resulting mixture was subjected to granulation, employing a spray drier, and subsequently dried. Thereafter, said granulated mixture was subjected to the main burning at 1,200° C. for 3 hours, whereby ferrite core material particles having a resistance of $4.3\times10^8$ Ω·cm were prepared.

Production of Covering Resin

Initially, a cyclohexyl methacrylate/methyl methacrylate (at a copolymerization ratio of 5/5) copolymer was synthesized employing an emulsion polymerization method in which the concentration in an aqueous solution medium employing sodium benzenesulfonate having an alkyl group having 12 carbon atoms as a surface active agent, and fine resinous particles were obtained having a volume average primary particle diameter of 0.1 μm, a weight average molecular weight (Mw) of 200,000, a number average molecular weight (Mn) of 91,000, an Mw/Mn of 2.2, a softening temperature (Tsp) of 230° C., and a glass transition temperature (Tg) of 110° C. Incidentally, said fine resinous particles were treated to be azeotropic with water and the residual monomer amount was adjusted to 510 ppm.

Subsequently, charged into a high-speed mixer employing stirring blades were 100 parts by weight of ferrite core material particles and 2 parts by weight of said fine resinous particles, and the resulting mixture was blended at 120° C. for 30 minutes, and utilizing mechanical impact force action, a resin coated carrier having a volume average particle diameter of 61 μm was prepared.

Production of Developer

Each type of colored particles added with external additives was blended with said carrier, and a developer, having a toner concentration of 6 percent by weight, was prepared.

Production of Photoreceptor P1

The coating compositions described below were applied onto a cylindrical conductive support having a diameter of 60 mm, whereby photoreceptor P1 was prepared.

| <Sublayer> | |
|---|---|
| Titanium chelate compound (TC-750, manufactured by Matsumoto Seiyaku Co.) | 30 g |
| Silane coupling agent (KMB-503, manufactured by Shin-Etsu Kagaku Co.) | 17 g |
| 2 - Propanol | 150 ml |

Said coating composition was applied onto a cylindrical conductive support so as to obtain a layer thickness of 0.5 μm.

| <Charge Generating Layer> | |
|---|---|
| Y type titanyl phthalocyanine (titanyl phthalocyanine having a maximum peak at 27.2 degrees of Bragg angle 2θ (±0.2 degree) in Cu-Kα characteristic X-ray diffraction spectrometry) | 60 g |
| Silicone modified butyral resin (X-40-1211M, manufactured by Shin-Etsu Kagaku Co.) | 700 g |
| 2 - Butanone | 2,000 ml |

were mixed and dispersed for 10 hours employing a sand mill, whereby a charge generating layer coating composition was prepared. The resulting coating composition was applied onto said sublayer employing a dip coating method, whereby a 0.2 μm thick charge generating layer was formed.

| <Charge Transport Layer> | |
|---|---|
| Charge transport material N-(4-methylphenyl)-N-{4-(β-phenylstyryl)phenyl}-p-toluidine | 225 g |
| Polycarbonate (having a viscosity average molecular weight of 30,000) | 300 g |
| Antioxidant (Exemplified Compound 1–3) | 6 g |
| Dichloromethane | 2000 ml |

were mixed and dissolved to prepare a charge transport layer coating composition. The resulting coating composition was applied onto said charge generating layer employing a dip coating method, whereby a charge transport layer having a dried layer thickness of 20 μm was formed.

| <Protective Layer> | |
|---|---|
| Methyltrimethoxysilane | 150 g |
| Dimethyldimethoxysilane | 30 g |
| Reactive charge transport compound (Exemplified Compound B-1) | 15 g |
| Polyfluorinated vinylidene particles (having a volume average particle diameter of 0.2 μm) | 10 g |
| Antioxidant (Exemplified Compound 2-1) | 0.75 g |
| 2 - Propanol | 75 g |
| 3 Percent acetic acid | 5 g |

were mixed to prepare a resinous layer coating composition. The resulting coating composition was applied onto said charge transport layer, employing a circular amount regulating type coating device so as to form a 2 μm thick resinous layer. The resulting layer was thermally hardened at 120° C. for one hour to form a siloxane resinous layer, whereby Photoreceptor P1 was prepared.

1-3

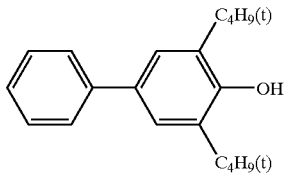

2-1

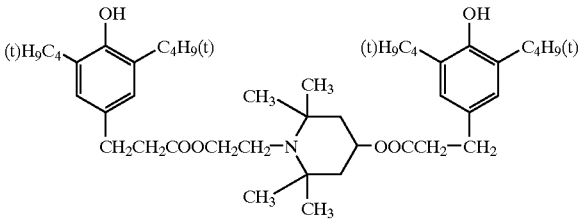

(B-1)

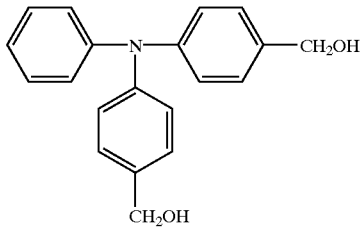

Photoreceptor P1 and each of developers were installed in a digital copier (comprising corona charging, laser exposure, reversal development, electrostatic transfer claw separation, and a cleaning blade) having image forming processes described in FIG. 5, and subsequently evaluated. Evaluation was carried out while setting said digital copier at the following conditions.

Charging Condition

Charging unit: scorotron charging unit. The initial charge potential was set at −750 V.

Exposure Condition

Exposure amount was set to result in an exposed area potential of −50 V.

Development Conditions

DC Bias: −550 V

Transfer Electrode: Corona Charging System

Further, the employed fixing unit comprised a heating roller having a surface roughness Ra of 0.8 μm, which was prepared by covering the surface of an iron cylinder with a 25 μm thick PFA (a tetrafluoroethylene-perfluoroalkyl vinyl ether copolymer) and a pressing roller having a surface roughness Ra of 0.8 μm, which was prepared by covering an iron cylinder with HTV silicone rubber which was further covered with a 120 μm thick PFA tube. Incidentally, its nip width was 3.8 mm and a linear rate was 420 mm/second.

Further, said cleaning unit was provided with neither a cleaning mechanism nor a silicone oil supplying mechanism. Fixing temperature was controlled employing said heating roller and set at 165° C.

As copying conditions, 500,000 copies were continuously prepared at low temperature and low humidity (10° C. and 20 percent relative humidity). The invisual off-setting resistance of copied images, the winding at high speed fixing, the life time of the fixing roller, the filming generation of the photoreceptor, abrasion of the photoreceptor and the life time of the photoreceptor as the test of affect to the image forming apparatus, and uniformity of half tone image and scattering toner around fine dots at 350,000 copies as the test of affect to the image were evaluated based on the criteria described below.

<Invisual Off-setting>

A felt pad having thickness of 5 mm and area of 10 mm×50 mm is become contact with a photoreceptor after 10,000 copies at 50 g/cm$^2$ ($5\times10^{-5}$ Pa), and stain was observed.

Rank A: No stain is observed on the surface of the pad.

Rank B: Slight stain is observed on the surface of the pad, but acceptable in practical use.

Rank C: Stain is observed on the surface of the pad, and not acceptable in practical use.

<High Speed Fixing>

Line speed was raised to 840 mm/sec and, after 20,000 sheets copying, solid black image was copied and winding property and fixing ratio was evaluated.

Rank A: No paper clogging due to insufficient fixing separation is observed, and no mark by separation nail is observed.

Rank B: No paper clogging due to insufficient fixing separation is observed, and slight mark by separation nail (acceptable in practical use) is observed.

Rank C: Paper clogging due to insufficient fixing separation (unacceptable in practical use) is observed.

Plain paper of A4-size having basis weight of 65 g/m$^2$ was employed in the test.

<Life Time of the Fixing Roller>

Sheet number in which first image stain by cracks of the fixing roller is found is counted for every 10,000 sheets.

<Filming of the Photoreceptor>

Filming on the photoreceptor was evaluated by eyes view.

Rank A: No filming is observed.

Rank B: Slight filming but acceptable in practical use is observed.

Rank C: Filming unacceptable in practical use is observed.

<Abrasion of the Photoreceptor>

The abrasion was evaluated by difference of thickness of the photoreceptor before and after 500,000 copies.

<Life Time of the Photoreceptor>

Numbers of sheets having fog density (relative density of non image portion of copied paper) of 0.01 or more was counted for every 10,000 sheets. The density was measured by employing densitometer PDA-65 manufactured by Konica Corporation.

<Uniformity of Halftone>

After continuous production of 500,000 copies, the photoreceptor filming as well as the uniformity of halftone images due to variation of transferability was evaluated based on the rank described below.

Rank A: uniform image without mottles

Rank B: presence of very slight streak-shaped mottles

Rank C: presence of several slight streak-shaped mottles, which are commercial viable Rank D: presence of more than several clear streak-shaped mottles Evaluation ranks A, B, and C were judged to be commercially viable and D was judged to be not commercially viable.

Minute Spots around Dot

A halftone dot image, which occupied 10 percent of the whole image, was prepared. Subsequently, tiny spots around dots were observed employing a hand magnifier, and evaluated based on the criteria described below.

A: tiny spots were barely noticed

B: there were slightly tiny spots, but if they were not carefully observed, they would not be noticed C: tiny spots were easily noticed Cleaning property, staining during bookbinding and defective characters are also evaluated for samples employing colored particles 201–213 and comparative colored particles 201–204

<Cleaning Property>

Number of the sheet found stain at non image portion due to toners which were not removed from the photoreceptor by insufficient cleaning was observed.

Rank A: No stain is found up to 500,000th sheet.

Rank B: Stain is found between 400,000th and 500,000th sheet.

Rank C: Stain is found at less than 400,000 sheet.

<Staining During Bookbinding>

Both sides of 64 g/m$^2$ plain paper sheet were copied and 100 copied sheets were subjected to bookbinding. Thereafter, each of all pages was manually turned 20 times and stain on the white background was observed.

Rank A: stain was not formed on the image

Rank B: very slight stain was formed on the image (at the level which does not result in any problem with commercial viability)

Rank C: slight stain was formed on the image (at the level which results in no problem with commercial viability)

Rank D: stain was formed on the image and resulted in no commercial viability.

Evaluation ranks A, B, and C were judged to be commercially viable and D was judged to be not commercially viable.

<Defective Characters>

Character image having 3 points and 5 points characters was printed, and evaluation was judged by the following criteria.

Rank A: Both of 3 points and 5 points characters are clearly readable.

Rank B: 3 points characters are partly difficult to read and 5 points characters are clearly readable. Commercially viable.

Rank C: 3 points characters are almost difficult to read and majority of 5 points characters are also difficult to read. Not commercially viable.

The results are summarized in Tables 6 and 7.

TABLE 6

| Colored Particle No. | Invisual off-setting | High speed fixing | Life time of fixing roller | Filming | Abrasion of photo-receptor | Life time of photo-receptor | Uniformity of Halftone | Minute Spots |
|---|---|---|---|---|---|---|---|---|
| 101 | A | A | No stain | A | A | No stain | A | A |
| 102 | A | A | No stain | A | B | No stain | B | A |
| 103 | A | A | No stain | A | B | No stain | B | A |
| 104 | A | A | No stain | A | B | No stain | B | A |
| 105 | A | A | No stain | A | B | No stain | B | B |
| 106 | A | B | No stain | A | B | No stain | B | B |
| 107 | B | B | No stain | B | B | No stain | B | B |
| 108 | B | B | No stain | B | C | No stain | C | B |
| 109 | B | B | No stain | B | A | No stain | A | B |
| 110 | A | B | No stain | A | A | No stain | A | B |
| 111 | A | B | No stain | A | B | No stain | B | B |
| 112 | B | B | No stain | B | B | No stain | B | B |
| 113 | B | B | No stain | B | B | No stain | B | B |
| 114 | A | A | No stain | A | B | No stain | B | B |
| 115 | A | A | No stain | A | B | No stain | B | B |
| 116 | B | B | No stain | B | B | No stain | B | B |
| Comp. 101 | C | C | 80,000 sheets | C | D | 200,000 sheets | D | C |
| Comp. 102 | C | C | 70,000 sheets | B | D | 200,000 sheets | D | C |
| Comp. 103 | B | C | 250,000 sheets | C | C | 200,000 sheets | D | C |
| Comp. 104 | C | C | 250,000 sheets | B | D | 100,000 sheets | D | C |
| Comp. 105 | C | C | 80,000 sheets | C | D | 100,000 sheets | D | C |

TABLE 7

| Colored Particle No. | Invisual off-setting | High speed fixing | Life time of fixing roller | Cleaning property | Staining during Bookbinding | Filming | Life time of photo-receptor | Uniformity of Halftone | Defective characters |
|---|---|---|---|---|---|---|---|---|---|
| 201 | A | A | No stain | A | B | None | No stain | A | A |
| 202 | A | A | No stain | A | B | None | No stain | A | A |
| 203 | A | A | No stain | A | B | None | No stain | A | A |
| 204 | A | A | No stain | A | B | None | No stain | A | A |
| 205 | A | A | No stain | A | B | None | No stain | A | B |
| 206 | A | B | No stain | A | B | None | No stain | B | B |
| 207 | B | B | No stain | B | B | None | No stain | B | B |
| 208 | B | B | No stain | B | C | None | No stain | B | B |
| 209 | B | B | No stain | B | A | None | No stain | A | B |
| 210 | A | A | No stain | A | A | None | No stain | A | B |
| 211 | A | A | No stain | A | B | None | No stain | B | B |
| 212 | B | B | No stain | B | B | None | No stain | B | B |
| 213 | B | A | No stain | B | B | None | No stain | B | B |
| Comp. 201 | B | C | 100,000 sheets | B–C | B | 180,000 sheets | 160,000 sheets | C | D |
| Comp. 202 | C | C | 90,000 sheets | C | B | 220,000 sheets | 170,000 sheets | D | D |
| Comp. 203 | C | B | 110,000 sheets | C | B | 160,000 sheets | 130,000 sheets | D | D |
| Comp. 204 | C | C | 80,000 sheets | C | D | 90,000 sheets | 120,000 sheets | D | D |

It was confirmed that invisual off setting was restrained, and further the fixing apparatus works continuously without changing parts for more than 300,000 sheets. Life time of the photoreceptor is also prolonged by use of toner of the invention in comparison with conventional tones.

What is claimed is:

1. A toner for developing a static image comprising at least a resin, colorant and a crystalline substance, wherein the toner particle has a domain-matrix structure, said matrix comprises said resin and said domain is a plurality of domains uniformly dispersed in said matrix wherein one domain comprises said colorant and another domain comprises said crystalline substance, and the domains have an average of the ratio of the major axis to the minor axis of from 1.15 to 2.5 when the domains are approximated by an ellipse, and the distribution of the angle of the major axis of the ellipse with the X axis optionally set on the electron microscopic photograph has zero, two or more peaks and the crystalline substance has a spectral transmittance between 84% and 99%.

2. The toner of claim 1, wherein the distribution of the angle of the major axis of the ellipse with the X axis optionally set on the electron microscopic photograph has two or more peaks.

3. The toner of claim 1, wherein the distribution of the angle of the major axis of the ellipse with the X axis optionally set on the electron microscopic photograph has no peak.

4. The toner of claim 1, wherein the domains are different in the luminance.

5. The toner of claim 1, wherein the DSC curve of the toner has an endothermic peak within the range of from 60 to 100° C. and an endotherm quantity of from 4 to 30 j/g.

6. The toner of claim 5, wherein an average of the smallest distance between walls of the domains is from 100 to 1060 nm, and domains each has the smallest distance between the wall of the neighbor domain of not less than 1300 nm account for not more than 10% in number of the whole domains.

7. The toner of claim 5, wherein an average of the smallest distance between walls of the domains is from 260 to 820 nm, and domains each has the smallest distance between the wall of the neighbor domain of not less than 1300 nm account for not more than 4% in number of the whole domains.

8. The toner of claim 5, wherein ratio of the domains which are not exposed at the surface of the toner particle is not less than 98%.

9. The toner of claim 8, wherein the average area of Voronoi polygons each formed by lines each perpendicularly and equally dividing the line connecting between the gravity centers of the neighbor domains is from 40,000 to 100,000 $nm^2$ and the variation coefficient of the area of the Voronoi polygon is not more than 20%.

10. The toner of claim 8, wherein the average area of Voronoi polygons each formed by lines each perpendicularly and equally dividing the line connecting between the gravity centers of the neighbor domains is from 20,000 to 120,000 $nm^2$, and the domains each having the Voronoi polygon having an area of not less than 160,000 $nm^2$ account for from 3 to 20% in number.

11. The toner of claim 8, wherein the average area of Voronoi polygons each formed by lines each perpendicularly and equally dividing the line connecting between the gravity centers of the neighbor domains existing outside of a circle having radius of 1,000 nm and the center at the gravity center of the cross section of the toner particle is larger than the average area of Voronoi polygons each formed by lines each perpendicularly and equally dividing the line connecting between the gravity centers of the neighbor domains existing inside the circle.

12. The toner of claim 8, wherein among Voronoi polygons each formed by lines each perpendicularly and equally dividing the line connecting between the gravity centers of the neighbor domains, exist from 5 to 30 domains having the Voronoi polygon which contact with the outside of the toner particle and has an area of not less than 160,000 $nm^2$.

13. The toner of claim 1, wherein the ratio of the particles having no corner is not less than 50% in number and a number variation coefficient in the particle size distribution in number is not more than 27%.

14. The toner of claim 13, wherein the ratio of the toner particles having a shape coefficient of from 1.2 to 1.6 is not less than 65% in number and a number variation coefficient in the particle size distribution in number is not more than 27%.

15. The toner of claim 14, wherein the toner has a number average particle diameter of from 3 to 9 $\mu$m.

16. The toner of claim 15, wherein sum M of a relative frequency m1 of the toner particles contained in the highest frequency class and a relative frequency m2 of the toner particle contained in the next high frequency class in a histogram of the particle size distribution in number is not less than 70%, in the histogram, natural logarithm of log D of the diameter of the toner particle D is graduated on the horizontal axis and toner particle size is classified by every 0.23 on the horizontal axis.

17. The toner of claim 16, wherein the toner particle is produced by polymerizing at least a polymerizable monomer in an aqueous medium.

18. The toner of claim 17, wherein the toner particle is produced by coagulating and melt-adhering particles of the resin.

19. The toner of claim 18, wherein the toner is produced by salting/melt-adhering a colorant particle and a combined fine particle of a resin prepared by dissolving the crystalline compound in a polymerizable monomer and then polymerizing the polymerizable monomer.

20. The toner of claim 19, wherein the toner is produced by salting/melt-adhering a colorant particle and a combined fine particle of a resin prepared by a poly-step polymerization method.

21. The toner of claim 19, wherein the toner is produced by adhering a resin layer by a salting/melt-adhering method on the surface of a resin particle and a colorant particle.

* * * * *